US006273332B1

(12) United States Patent
Todjar-Hengami

(10) Patent No.: US 6,273,332 B1
(45) Date of Patent: Aug. 14, 2001

(54) PACKAGE DESIGN

(76) Inventor: David Todjar-Hengami, 4455 Torrance Blvd., #356, Torrance, CA (US) 90503

( * ) Notice: Subject to any disclaimer, the term of this patent is extended or adjusted under 35 U.S.C. 154(b) by 0 days.

(21) Appl. No.: 09/303,943

(22) Filed: May 3, 1999

Related U.S. Application Data

(63) Continuation-in-part of application No. 09/088,472, filed on Jun. 1, 1998, now Pat. No. 6,116,499.

(51) Int. Cl.[7] ..... B65D 5/56; B65D 43/20

(52) U.S. Cl. ..... 229/129.1; 229/117.28; 229/117.3; 229/117.35; 229/122; 229/164.2

(58) Field of Search ..... 229/117.27, 117.28, 229/117.3, 117.31, 117.35, 122, 125.12, 129.1, 164.2, 242; 222/105, 183

(56) References Cited

U.S. PATENT DOCUMENTS

| | | | |
|---|---|---|---|
| 1,432,932 | 10/1922 | Weis . | |
| 2,162,632 | 6/1939 | Meek . | |
| 2,254,608 | 9/1941 | Heyer . | |
| 2,426,911 | 9/1947 | Williamson . | |
| 3,071,306 | 1/1963 | Hewey . | |
| 3,186,628 | 6/1965 | Rohde . | |
| 3,768,719 | 10/1973 | Johnson . | |
| 3,819,093 | 6/1974 | Forbes, Jr. . | |
| 4,066,207 | 1/1978 | Jorgenson-Beck et al. . | |
| 4,081,128 | 3/1978 | O'Neill . | |
| 4,094,456 | 6/1978 | Roccaforte . | |
| 4,193,648 | 3/1980 | Gargiulo . | |
| 4,201,329 | 5/1980 | Roccaforte . | |
| 4,671,449 | 6/1987 | Fronduti . | |
| 4,919,306 | 4/1990 | Heaps, Jr. et al. . | |
| 5,023,122 | 6/1991 | Boeckmann et al. . | |
| 5,335,996 | 8/1994 | Cortopassi et al. . | |
| 5,348,219 | 9/1994 | Brintazzoli . | |
| 5,464,285 | 11/1995 | Anderson . | |
| 5,492,270 | 2/1996 | Avery et al. . | |
| 5,505,373 | 4/1996 | von Stillfried . | |
| 5,609,901 | 3/1997 | Geddes et al. . | |
| 6,116,499 * | 9/2000 | Todjar-Hengami | 229/117.3 |

* cited by examiner

*Primary Examiner*—Gary E. Elkins
(74) *Attorney, Agent, or Firm*—Oppenheimer Wolff & Donnelly LLP

(57) ABSTRACT

Broadly defined, the present invention is an improved packaging system for products that can be poured. Most commonly, those products will be solid pourable products, such as cereals, candies, rice, detergents, and a multitude of other products. However, in a broad sense, the packaging system can be used with liquids and other pourable products. One aspect of the present invention is a box with an opening and a mechanism to open and close the opening. The system includes a liner. The liner may have a removable portion, defined by one or more lines of weakness or by other means such as a removable sticker. The removable portion of the liner is aligned with the box opening. The system can optionally include a cartridge, into which the liner is affixed, for insertion into the box. The cartridge serves to maintain the liner in the proper position within the box. As another option, the system can include a sound module. As the box is opened, the sound module is activated. The sound module can play music, an advertising message, and/or any combination of sounds for that sound modules can generate.

15 Claims, 21 Drawing Sheets

311
318
324
319
322
321
317
322
320
315
314
307
305
316
302
304
306
313
310
301

PACKAGE DESIGN

I. RELATED PATENT

This is a continuation-in-part of U.S. patent application Ser. No. 09/088,472, U.S. Pat. No. 6,116,499 which was filed on Jun. 1, 1998 and which is hereby incorporated by reference. This patent application also relates to U.S. Pat. No. 5,505,373, which is entitled Folding Package and which issued on Apr. 9, 1996 and which is also hereby incorporated by reference.

II. BACKGROUND OF THE INVENTION

A. Field of the Invention

The present invention relates to the field of packaging and, in particular, to packaging for pourable food and other items.

B. Prior Art

A wide range of pourable products, such as candies, cereals, laundry soaps, and many other products, are dispensed in cardboard boxes. To access the contents, a user must generally open the top of the box. Sometimes the contents are held in a wax paper bag inside the box, and the bag must be opened as well. To store the contents, the user closes the bag and then closes the box.

U.S. Pat. No. 5,505,373 discloses a novel box for conveniently storing and dispensing pourable items. The box has a back wall and a slide connected to the back wall. The slide has a slide opening and two side tabs extending from the slide. A front wall with an opening is connected to the back wall. The box also has an interior supporting wall having first and second side slits. The slide is disposed within the box, with each of the tabs being inserted into a corresponding one of the slits. The box has an open position in which the openings are aligned and in which the contents of the box may be poured out. The box also has a closed position for storing the contents.

III. SUMMARY OF INVENTION

Broadly defined, the present invention is an improved packaging system for products that can be poured. Most commonly, those products will be solid pourable products, such as cereals, candies, rice, detergents, and a multitude of other products. However, in a broad sense, the packaging system can be used with liquids and other pourable products.

One aspect of the present invention is a box with an opening and a mechanism to open and close the opening. The system includes a liner. The liner may have a removable portion, defined by one or more lines of weakness or by other means such as a removable sticker. The removable portion of the liner is aligned with the box opening.

The system can optionally include a cartridge, into which the liner is affixed, for insertion into the box. The cartridge serves to maintain the liner in the proper position within the box.

As another option, the system can include a sound module. As the box is opened, the sound module is activated. The sound module can play music, an advertising message, and/or any combination of sounds for that sound modules can generate.

In one particular embodiment of the invention, a system for conveniently storing and dispensing pourable items has a front wall with an opening and an inside surface, a back wall, a first and a second side wall, a top and a bottom flap and a slide that is in contact with the inside surface of the front wall, said slide having an opening. The front wall, back wall, first and second side walls, and top and bottom flaps are interconnected so as to form a box. The slide is movable between an open position in which the slide opening substantially aligns with the front wall opening and a closed position in which said slide opening is entirely out of alignment with the front wall opening, thereby closing the box. An inner liner inside said box has a removable area defined by one or more lines of weakness. The removable area is positioned adjacent to at least a portion of the front wall opening. The system also has a retaining cartridge for the inner liner.

Related embodiments may have one or more other features. The lines of weakness on the bag may be perforations. Alternatively, instead of lines of weakness, the bag may simply be made of a material through which the user can cut an opening with a knife or other cutting tool. The cartridge may have four sides, three sides, or even two sides. A one-sided cartridge is also possible. The system may include a liner retention band that typically extends about the cartridge, to hold the bag within the cartridge. The system may include a sound module. In one embodiment, the sound module is activated when the slide is lifted into the open position, to play sounds that have been stored within the module, such as voices, music and the like. In another embodiment, graphics are printed on the slide such that when the slide is in the closed position, the graphics are visible through the opening in box.

Various other aspects of the invention will become apparent from a review of the Detailed Description below, the Drawings and the Claims.

IV. BRIEF DESCRIPTION OF THE DRAWINGS

V. DETAILED DESCRIPTION OF THE PREFERRED EMBODIMENT

Figure 1:
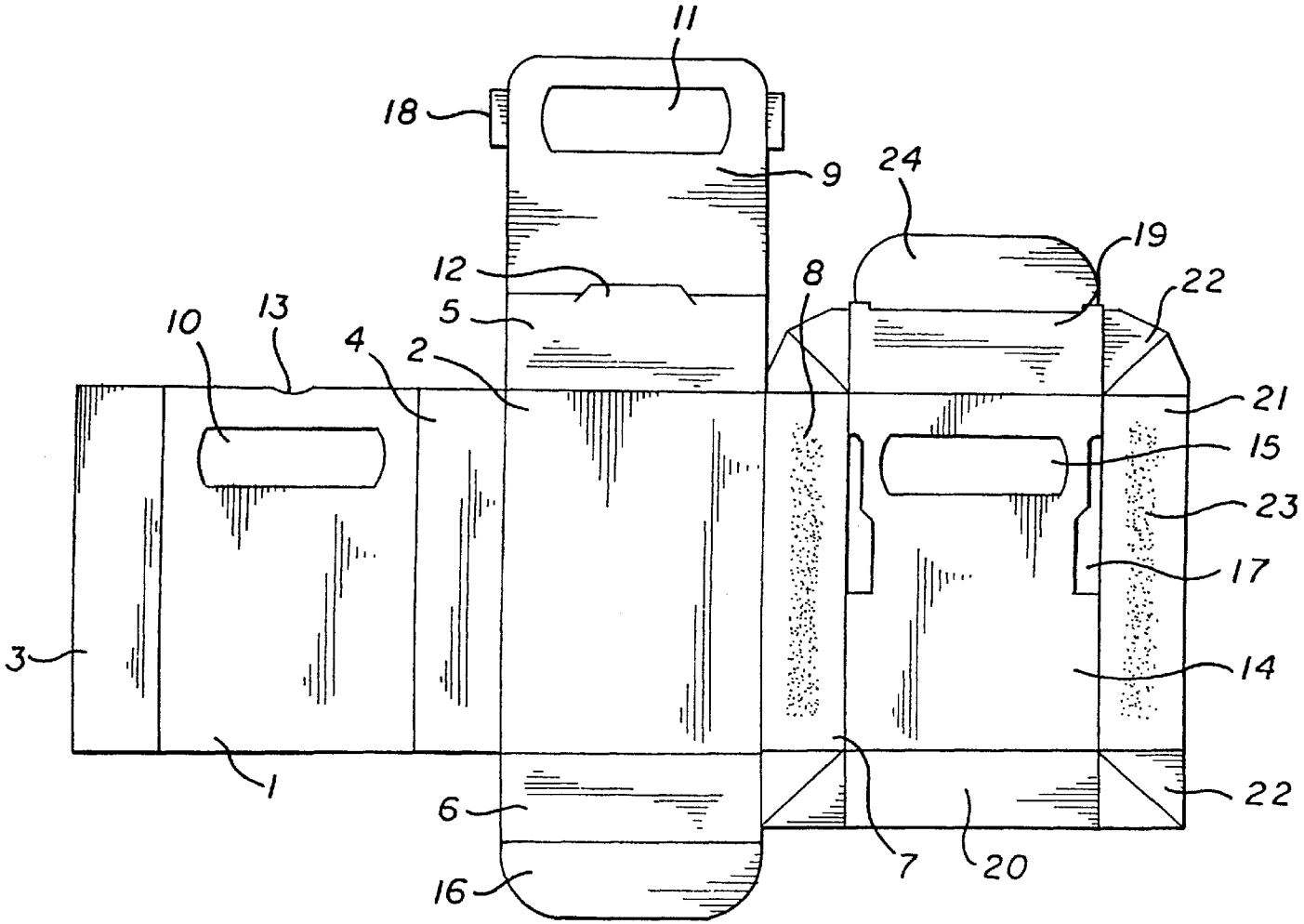
FIG. 1 (PRIOR ART)
FIG. 1 illustrates a blank from which a box according to the present invention is formed.

The box formed from the blank according to FIG. 1 has six outer walls, namely a front wall 1 and a back wall 2, a first side wall 3 and a second side wall 4 and a top flap 5 and a bottom flap 6. Between two of these walls the cross-section has folding lines F that define the edges of the finished box. A partition 7 is connected to the back wall 2 by a folding line. Partition 7 has a coating 8 of adhesive to bond the partition to the inside surface of the first side wall 3.

A bottom tongue 16 is connected to the bottom flap and its outside surface is in contact with the inside surface of front wall 1 when the box is completely assembled. A slide 9 is connected to the top flap 5 by a folding line and its outside surface is also in contact with the inside surface of front wall 1 when the box is fully assembled.

Front wall 1 has an opening 10. A corresponding slide opening 11 with a matching shape is provided in slide 9. When the top flap 5 is raised by thumb flap 12, slide 9 is raised along the inside surface of front wall 1 so the slide opening 11 comes to cover the opening 10 in front wall 1. Now the pourable product can be poured or shaken out of the box through the corresponding openings in the front wall 1 and slide 9. When pressure is applied from above to push the top flap 5 of the slide 9 down behind the front wall 1, the unperforated section of slide 9 closes off the opening 10 in the front wall. A recess 13 that facilitates the engagement of thumb flap 12 is provided in the front wall 1 in order to make it easier to open the box.

A supporting wall 14 is connected to the partition 7. When the box has been fully assembled, the supporting wall is on the inside next to the front wall 1. It has essentially the same dimensions as the front wall 1, and specifically it has an opening 15 which corresponds to the opening 10 in the front wall when the box is fully assembled.

The slide 9 is between the front wall 1 and the supporting wall 14 when the box is assembled, as is the lower tongue 16 that is connected to the bottom flap 6. The supporting wall 14 has two slits 17. The two straps 18 that project at a right angle from the slide in the direction of the interior of the box after the box has been assembled engage into these two slits. This forms a stop that defines the position of the slide 9 with regard to the supporting wall 14 and the front wall 1 when the box is open and prevents the slide from pulling out of the space between front wall 1 and supporting wall 14.

A top inner wall 19, a bottom inner wall 20 and a side inner wall 21 are attached to the side wall 14. There are four corner flaps 22, each arranged in a corner between the inner walls and the partition. The corner flaps are attached to the neighboring walls by fold lines, and another fold line divides each corner flap into two parts, so the corner flaps are folded into the inside of the box when the box is assembled.

The inner side wall 21 has an adhesive coating 23 for bonding it to the inside surface of the second side wall 4.

When the box is assembled, the bottom inner wall 20 is beneath the bottom flap 6 and the top inner wall 19 is beneath the top flap 5. The top tongue 24 that is attached to the top inner wall 19 is in contact with the inner surface of the back wall 2. The top inner wall 19 seals the box at the top, even when the top flap 5 is raised in order to open the box at openings 10, 11 and 15 by lifting the slide.

The blank of FIG. 1 is preferably die cut or laser cut from a sheet of material such as light cardboard or other material suitable for forming a box. The blank may be scored at fold lines to facilitate easily folding the blank into a box. The box is typically secured together with one of the adhesives that is conventional in the art.

Figure 3:
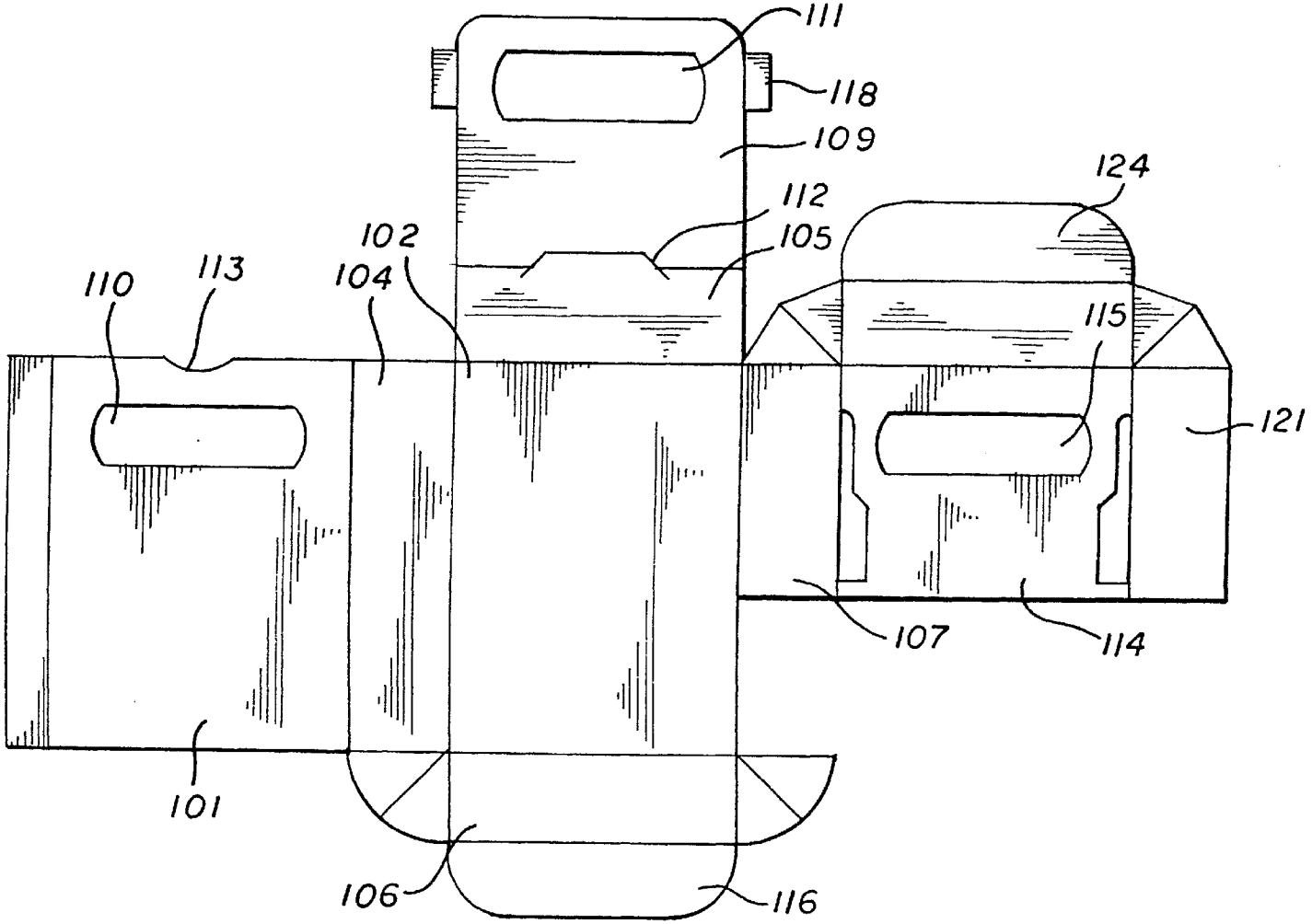
FIG. 3 illustrates a blank from which an alternative embodiment of the present invention is formed.

FIG. 3 illustrates an alternative design that requires somewhat less material to construct. The components of the design are numbered consistently with the components of FIG. 1, with the numbering increased by 100. The supporting wall 114 is somewhat shorter than the supporting wall 14 in FIG. 1. The partition 107 may also be somewhat shorter than the partition 7 in FIG. 1. In the embodiment of FIG. 1, there is a side wall 3 that the embodiment of FIG. 3 does not include, for the purpose of further saving material.

In FIG. 3, the supporting wall 114, the partition 107, and the inner side wall 121 are approximately one-half the length (or other shortened length) of corresponding wall 14, partition 7 and inner side wall 21 in FIG. 1. When hundreds of thousands or millions of the same box are produced, the shortened walls and partition can result in a large savings of material and reduced production costs. Eliminating the side wall 3 of FIG. 1 can further reduce the material and cost requirements.

Figure 4:
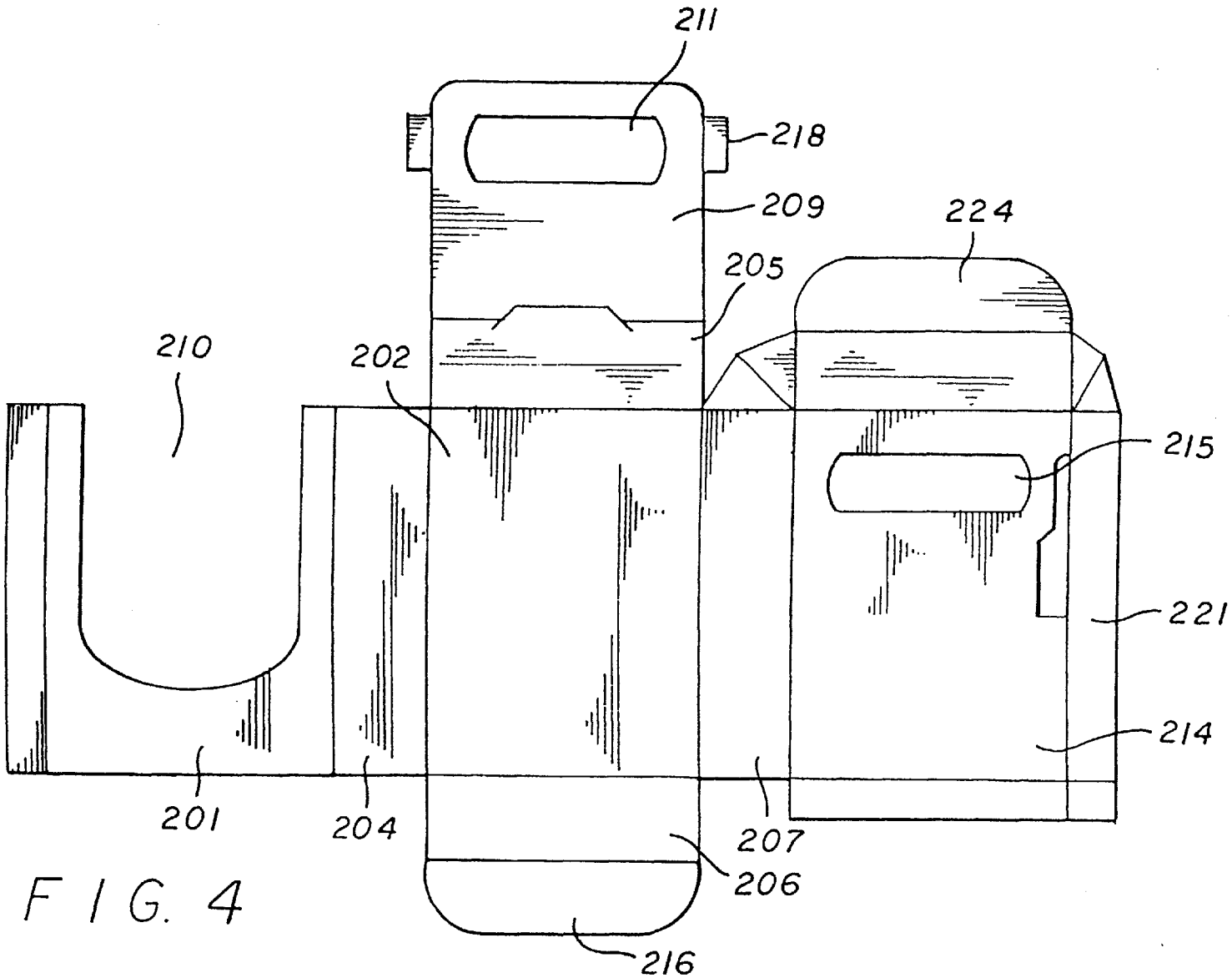
FIG. 4 illustrates a blank from which another alternative embodiment of the present invention is formed.

FIG. 4 illustrates a further alternative design. The components of the design are numbered consistently with the components of FIG. 1, with the numbering increased by 200. In this embodiment, the opening 210 is substantially larger than the corresponding opening 10 in the embodiment of FIG. 1. To further save material, the height of the supporting wall 214, inner side wall 221 and partition 207 can be reduced as in FIG. 3. Alternatively, the inner side 221 and supporting wall 214 can be eliminated entirely. To form the box, the front wall 201 would then be connected to partition 207, which could be provided with an extension to which front wall 201 could be adhered. Bottom tongue 216 could also be eliminated.

Figure 5:
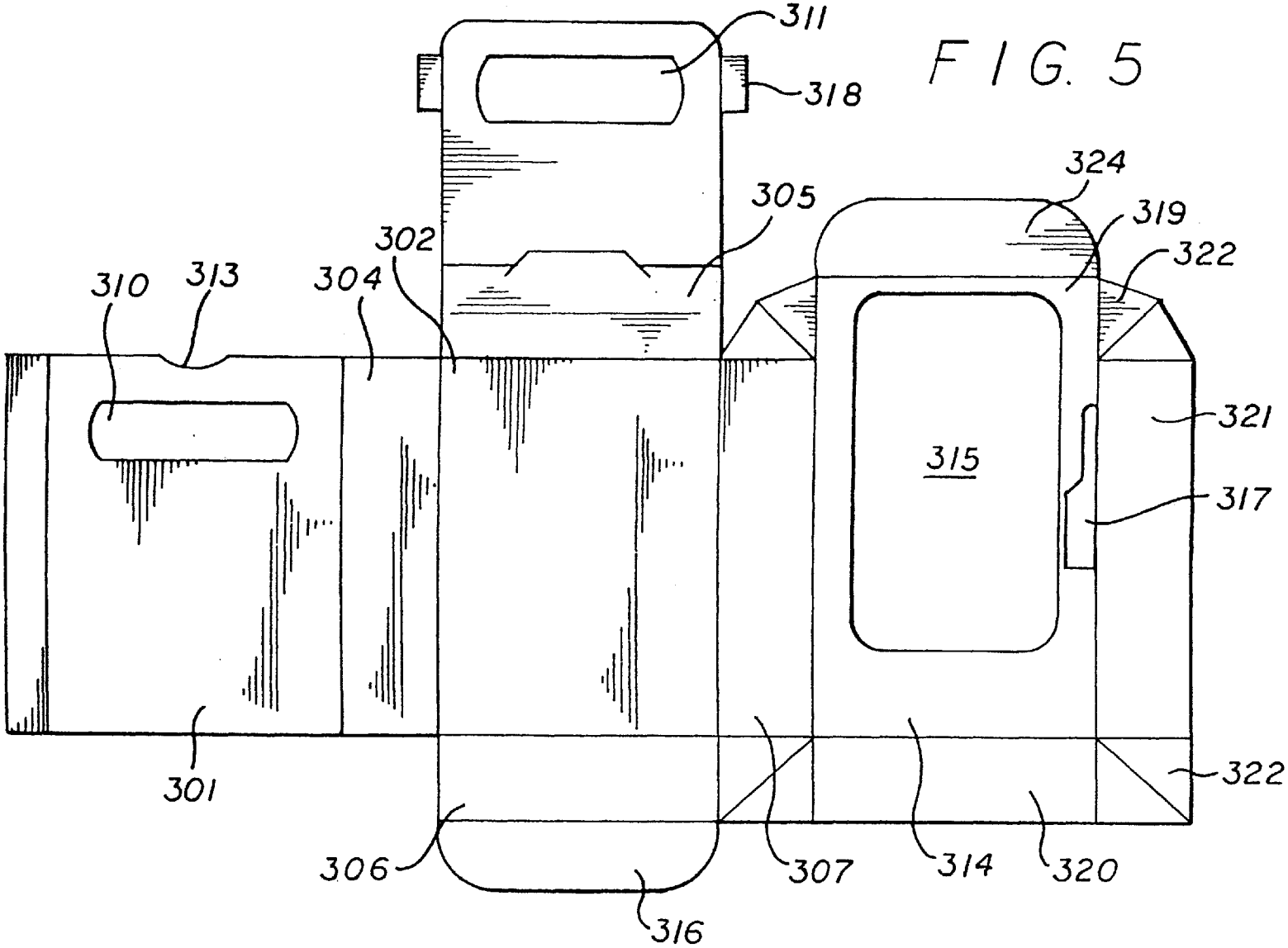
FIG. 5 illustrates a blank from which a further alternative embodiment of the present invention is formed.

FIG. 5 illustrates a further alternative design in which the opening 315 is enlarged in order to save material. The opening 315 extends into the top inner wall 319, and below the midpoint of the supporting wall 314. The first side wall 3 of FIG. 1 is also eliminated. The tabs 318 are optional and, if eliminated, the slits 317 may also be eliminated.

Material may be added or reduced from the box designs depending on the type of pourable product that is to be stored in the box. For example, the box may require more rigidity in order to store heavier items such as rice or some candies. Consequently, the design of FIG. 1 may be preferred over the design of FIG. 4 or FIG. 5 for use with certain products. On the other hand, lighter items, such as popcorn, dried pastas, and many other light weight products, may be stored in a box requiring less material than the design of FIG. 1.

Various embodiments of the present invention may be used in conjunction with a bag that fits inside the box. The general concept of bags within a box is conventional. For example, cereal is generally stored inside a wax paper or cellophane bag that the user opens from the top in order to pour the cereal from the box.

Figure 6:
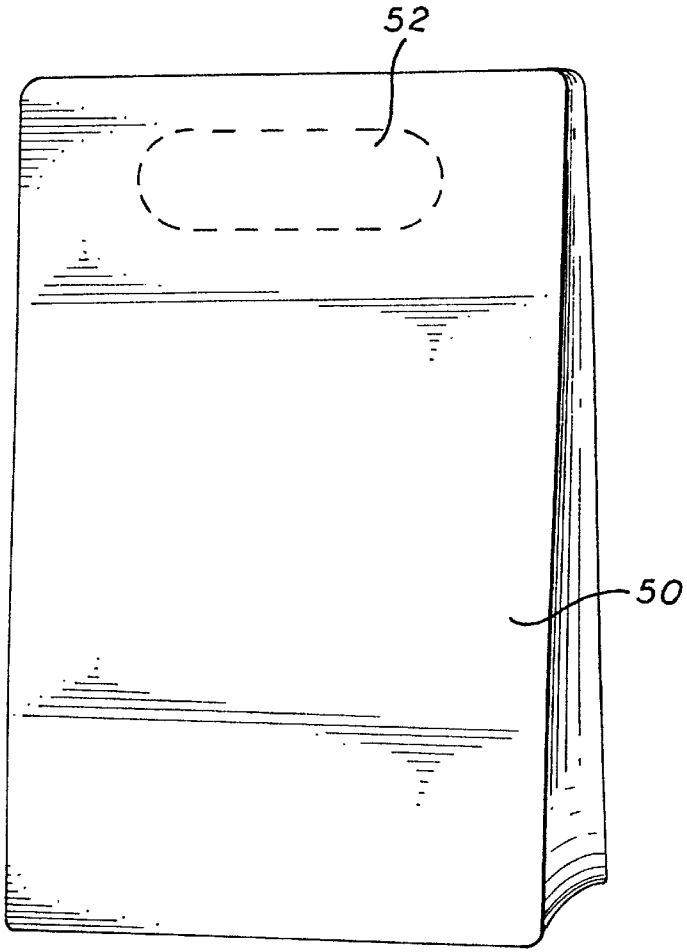
FIG. 6 illustrates one embodiment of an inner liner according to the present invention.
Figure 2:
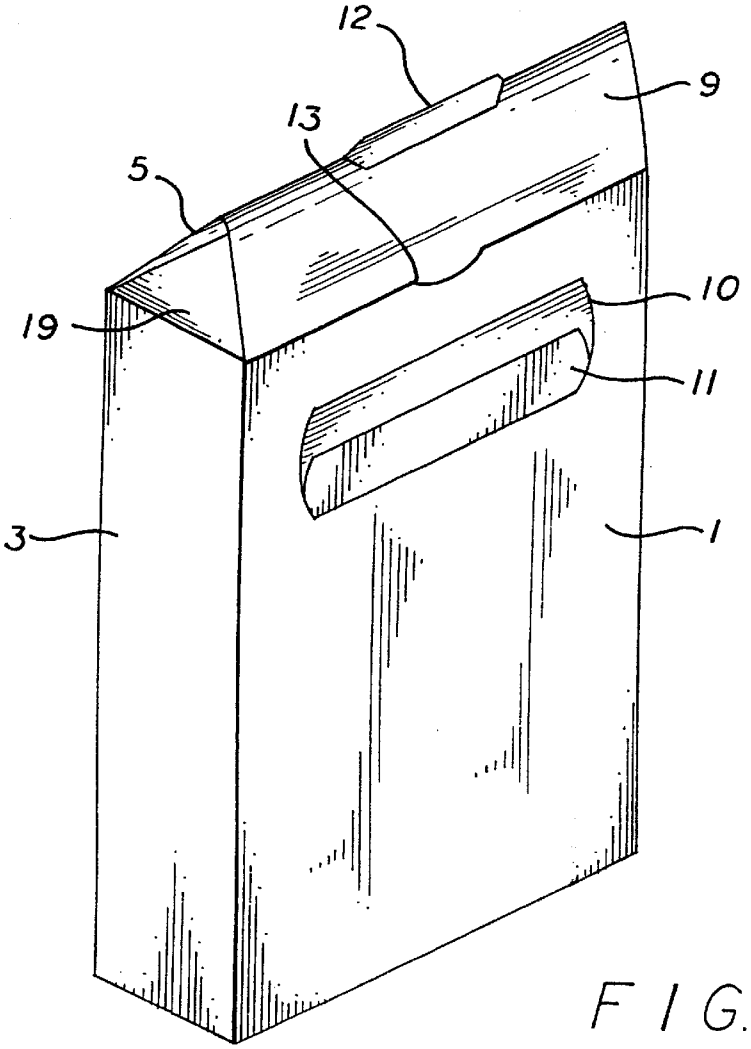
FIG. 2 (PRIOR ART)
FIG. 2 is a perspective view of the box designed from the blank of FIG. 1 in a half-opened state.

FIG. 6 illustrates a bag 50 having a perforated area 52. The perforated area 52 is positioned to correspond with the box opening 10, for example, in FIG. 2. Referring to FIG. 2, to open the bag, the user slides the slide 9 into the open position. The user then opens the bag 50 by reaching through the box opening 10, grasping the perforated area of the bag 52, and removing the area of the bag defined by perforations 54. The bag is then open, and the user can pour contents of the bag 50 through the now-opened portion of the bag, and out of the box through the opening 10.

In the presently preferred embodiment of the bag 50, the perforated area 52 is defined by microperforations, which are fine perforations that leave a relatively smooth edge after separation. However, alternatively, other types of perforations may be used. As an alternative to perforations, other forms of weakening may be employed, such as scoring.

As a further alternative, the bag 50 may be provided with an aperture. A sticker that is backed with a removable adhesive is applied to the bag 50 to seal off the aperture. To open the bag, the user removes the sticker from the aperture, so that the user may pour contents of the bag through the bag aperture and out the box aperture when the box is in the open position. The sticker may have a preprinted design and/or indicia on one or both surfaces. The bag may be provided with a release coating such as silicone to facilitate easy removal of the sticker. Alternatively, the bag may be constructed of a material from which the sticker may be peeled without a release coating. To reseal the bag, the user may replace the sticker on the bag. Alternatively, the user may seal the opening of the box itself with the sticker.

Figure 7:
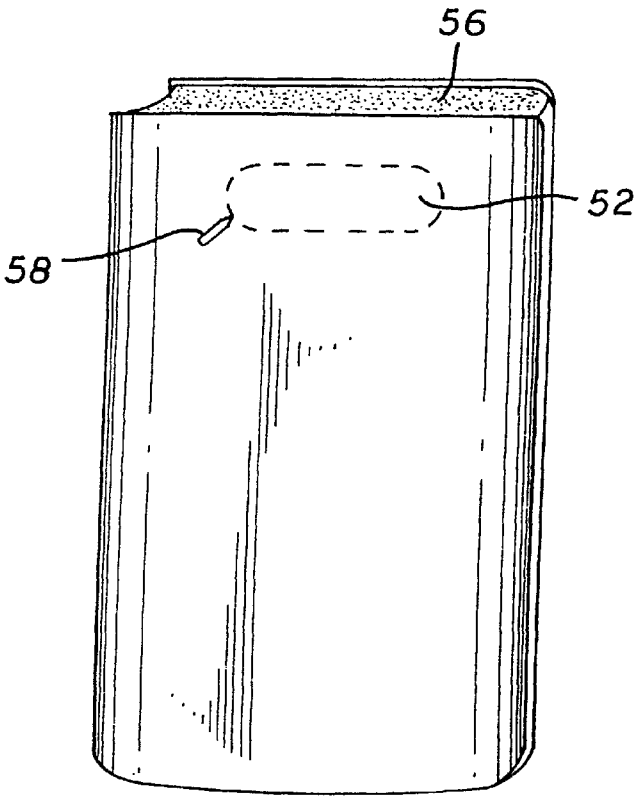
FIG. 7 illustrates an alternative embodiment of the inner liner of FIG. 6.

The bag 50 may be adhered to the interior of the box in order to ensure that the bag opening remains aligned with the box opening 10. In one embodiment, the top of the bag 56 (FIG. 7) is adhered to the top interior of the box. The bag may also be adhered to the side of the box or, in some embodiments, may be adhered to the bottom of the box, or may be otherwise secured within the box so that the bag opening aligns with the box opening in the open position. In one embodiment, the bag is glued to the interior of the box immediately adjacent to the box opening, so that the bag opening is held in alignment with the box opening.

The perforated area 52 may optionally be connected to a tab 58 to simplify opening the bag. When the box is open, the user may reach through the box opening 10, grasp the tab 58, and pull the tab in order to remove the area 52 from the bag. The tab 58 may be made of the same material as the bag or, alternatively, may be made of a different material. The tab 58 may be formed integrally with the bag as, for example, by simply die-cutting a tab out the portion 52. However, the tab 58 is preferably a separate member that is attached to the area 52 by conventional means.

Figure 8:
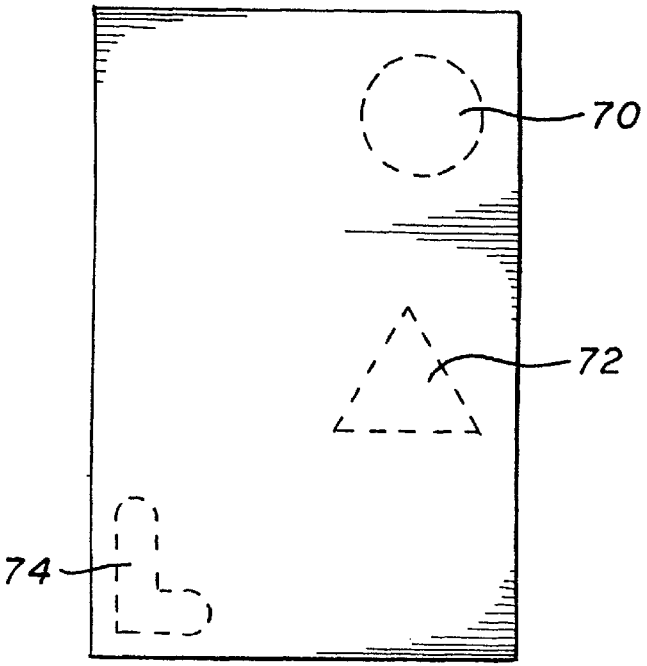
FIG. 8 is a view of one side of a box according to the present invention having more than one front opening.

The foregoing has described a presently preferred embodiment of the invention, as well as alternative embodiments. However, it should be understood that the scope of the invention is not limited to what is described in the Detailed Description. Numerous variations may be employed within the scope of the invention. For example, referring to FIG. 1, the opening 10 may be located at various other positions on the box. Referring to FIG. 8, the opening may be moved to an upper corner, to one side of the center, and/or to a lower corner. Any other position on the front is possible. The slide opening 11 (FIG. 1) should be located on the slide so as to be out of alignment with the box opening when in the closed position, and aligned with the box opening in the open position, so that the user can open and close the box opening by sliding the slide.

Figure 10:
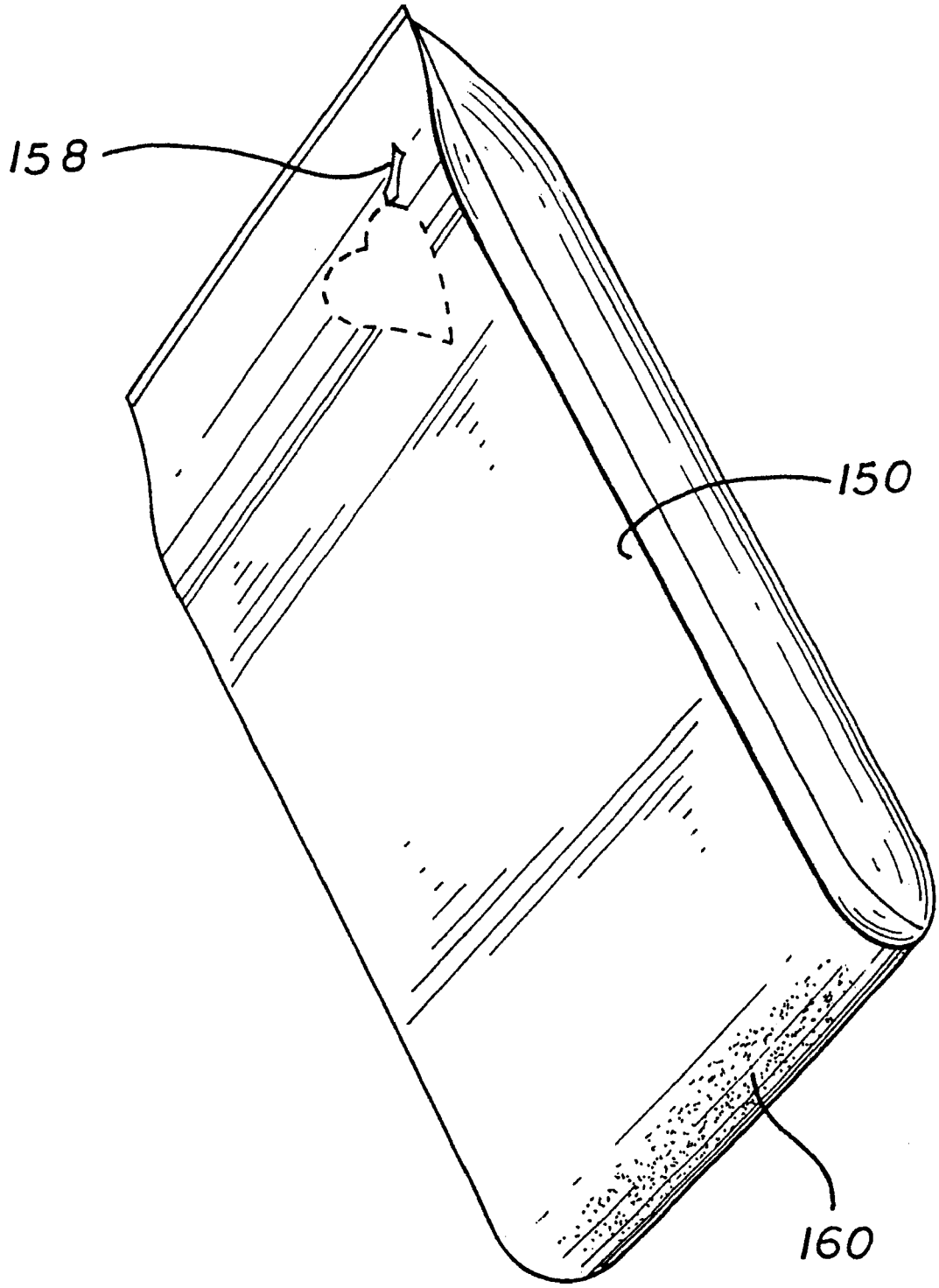
FIG. 10 illustrates a bag that is compatible with the box formed from the blank of FIG. 9, in which the perforated removable portion of the bag is heart-shaped to correspond with the heart-shaped opening of the box.

Referring again to FIG. 8, the opening can have any shape, such as circle 70, triangle 72, or L-shape 74. A wide range of opening shapes and sizes is available. FIG. 10 illustrates that the openings in the box may have a shape to correspond with the shape of the opening in the bag.

The box and the bag may each have more than one opening. The slide may have a plurality of openings, too, so that in the open position, several box openings are opened simultaneously. Alternatively, the openings in the slide may be such that sliding the slide a certain distance opens less than all of the box openings. With further sliding, one or more additional openings may be opened. As a further alternative, the box and bag may be provided with several openings, while the slide is provided with only one opening. The slide opening can then be moved from box opening to box opening, allowing the user to choose from which opening to pour.

Figure 9:
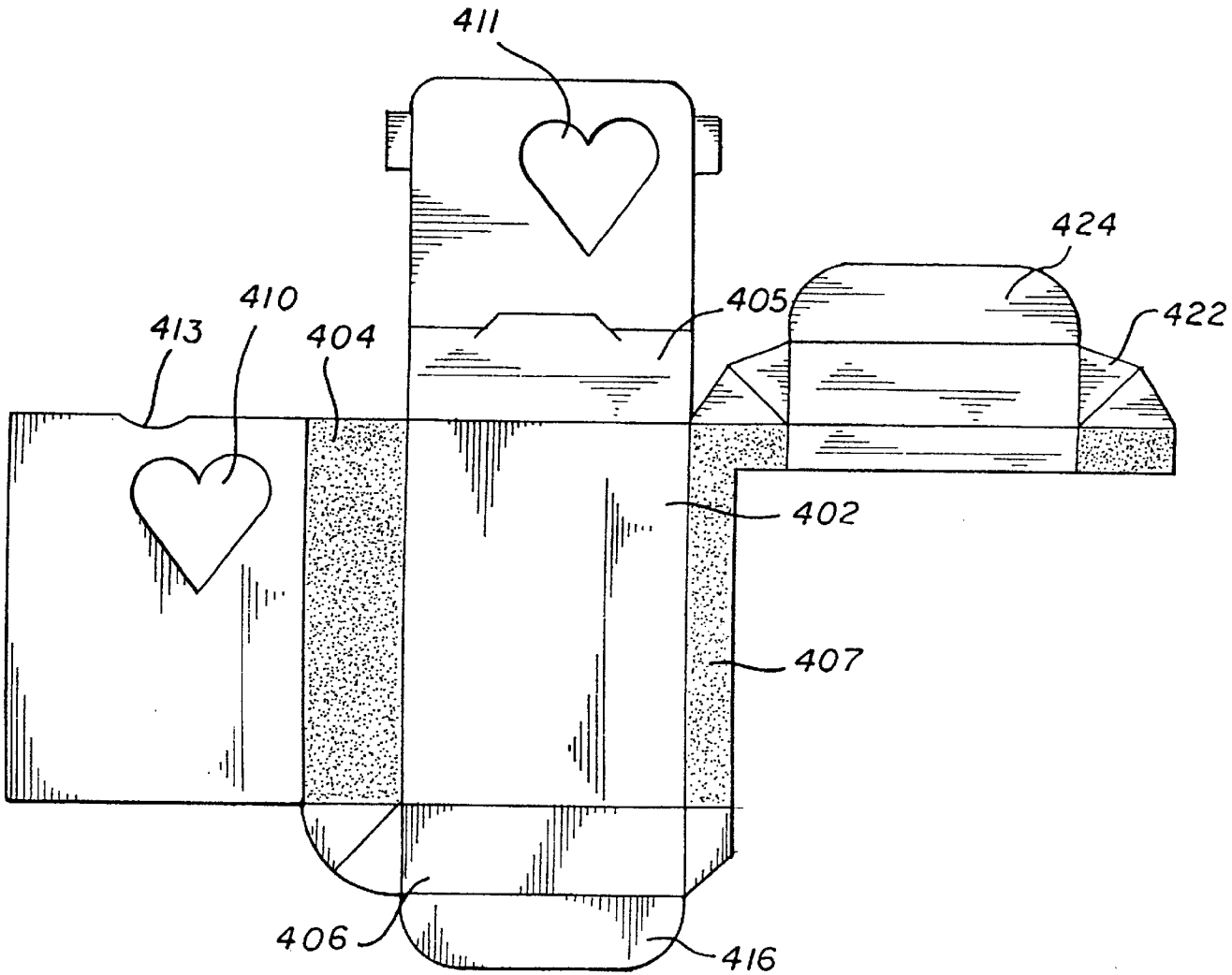
FIG. 9 illustrates a blank from which another alternative embodiment of the present invention is formed, this embodiment having a heart-shaped opening.

FIG. 9 illustrates an alternative embodiment of the present invention in which the various components are numbered consistently with the numbering of FIG. 1, with 400 added. In FIG. 9 the box openings 410 and 411 are heart-shaped, rather than the elongated, narrow shape of opening 10 in FIG. 3. If an inner bag is used inside the box, the bag may also have a heart-shaped opening.

The box of FIG. 9 has a portion 422 that folds inside of the box. The lower portion of 422 may be glued in place to secure the blank into a box. Relatively little material is required to form the right hand side of the blank illustrated in FIG. 9, and the embodiment of FIG. 9 is particularly material-efficient.

FIG. 10 illustrates one embodiment of a bag 150 that is compatible with the box of FIG. 9. The bag of FIG. 10 has a removable heart-shaped area 152 defined by one or more lines of weakness, preferably perforations. The position of the heart-shaped area 152 corresponds with heart-shaped opening 410 in the box of FIG. 9. The bag 150 may be glued in place at the bottom of the bag 160 or else where the box to align the heart shaped area 152 with box opening 410.

Figure 11:
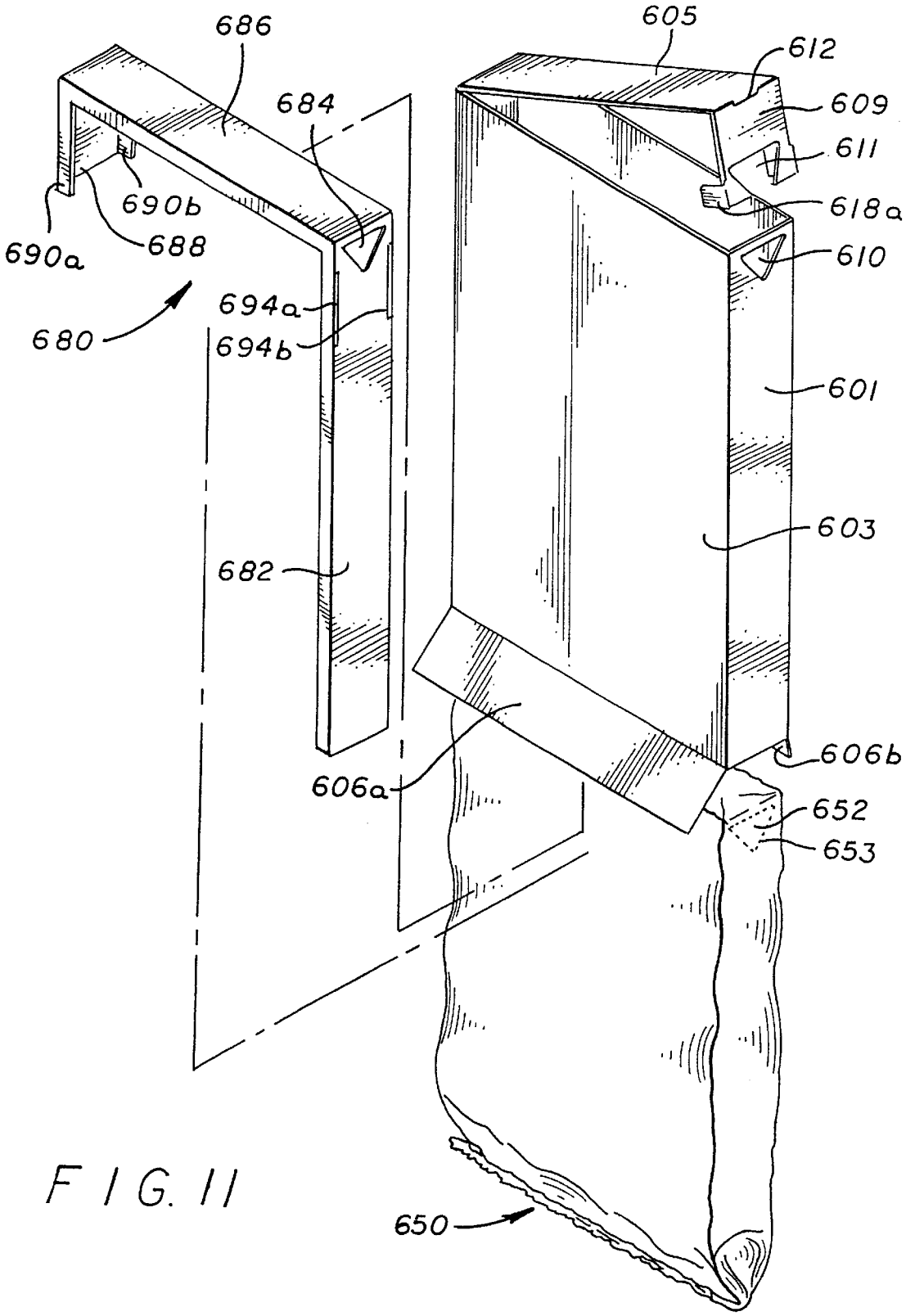
FIG. 11 illustrates the components of an embodiment having a cartridge into which the bag is placed, the cartridge then being inserted with the bag into the box.

FIG. 11 illustrates a further alternative embodiment of the present invention. In this embodiment, the invention has three components: a box, a bag and a cartridge into which the bag is secured prior to insertion into the box. The box has a front panel 601 and a side panel 603. A top flap 605 is connected to a slide 609 by a fold line. The front panel 601 has an opening 610 which generally corresponds in shape to the substantially-triangular opening 611 in slide 609. A thumb flap 612 exists in between the top flap 605 and the slide 609. The box also has the bottom flaps 606A and 606B.

The bag 650 typically contains cereal, rice, or another pourable food product. As discussed previously, however, the bag does not necessarily carry food but can carry any of a wide variety of pourable products. The bag 650 includes a removable area 652 that is defined by perforations 653. As will be explained later, the user removes the removable portion 652 prior to pouring out the contents of the bag 650.

Associated with the bag 650 is a cartridge 680. The purpose of the cartridge is to provide a convenient method of inserting bat 650 into the box. In practice, the bag 650 is secured within the cartridge 680, and then the cartridge 680 is inserted into the box. After the cartridge is inserted into the box, the bottom flap 606A and 606B are secured together to secure the bottom of the box.

The cartridge 680 includes a front panel 682, and an opening 684 in the side panel 682 corresponding to the shape of the opening 610 in the box. The cartridge 680 also has a top panel 686 and a rear panel 688. Rims 690A and 690B extend along the sides of the cartridge 680 to help retain the bag 650 within the cartridge. It should be noted that the bag 650 is typically glued or otherwise secured within the cartridge 680 before the cartridge 680 is fit within the box during production. The removable portion 652 of the bag 650 is positioned within the cartridge 680 so that the removable portion 652 aligns with openings 684 of the cartridge. It should be noted that the removable portion 652 does not necessarily need to be the same shape as the opening 684, so long as the shapes are sufficiently compatible so as to allow food or other pourable matter that is stored within bag 650 to pour out of the bag and through the opening 684 in the cartridge 680. The front panel 682 of the cartridge 680 may also include slots 694A and 694B, into which flaps 618A and 618B are secured respectively.

With the cartridge design of FIG. 11, the bag may be secured within the cartridge 680 for a rapid and accurate placement within the box during production. By securing the bag 650 within the cartridge 680, the alignment of the bag with the opening 610 in the box is assured. It is possible that without the cartridge 680 or an equivalent mechanism, the bag 650 would change position within the box, thereby causing the removable portion 652 on the bag 650 to move out of alignment with opening 620 in the box. The cartridge 680 therefore helps to insure the proper functioning of the overall system to the end user.

Figure 12:
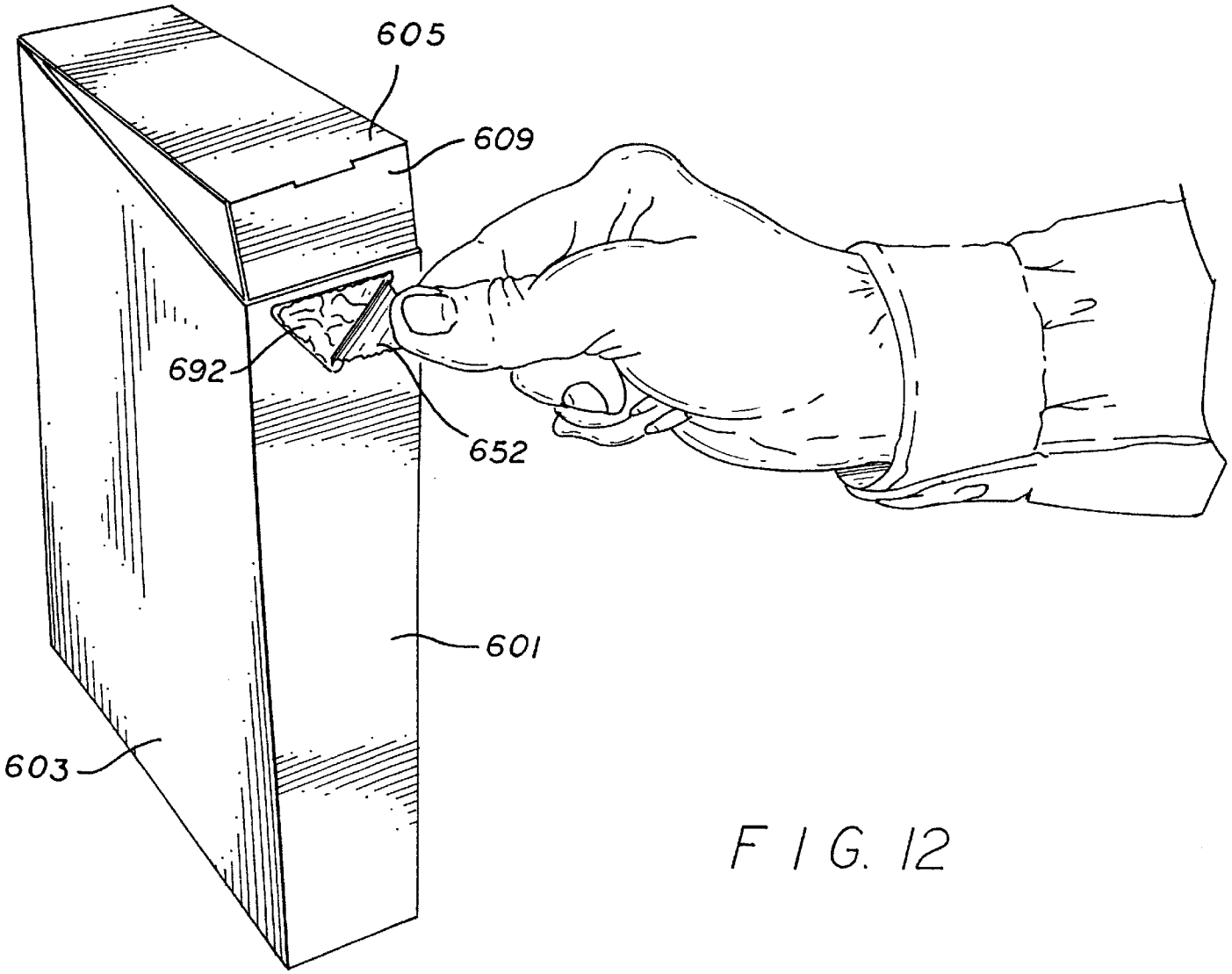
FIG. 12 illustrates a user removing the removable bag from the serial bag in the embodiment of FIG. 11.

FIG. 12 illustrates how the removable portion 652 is aligned with the opening 610 in the front portion 601 of the box. When properly aligned and when the top flap 605 is moved into the open position of FIG. 12, the user is able to grasp the removable portion 652 and remove it by separating the removable portion 652 along perforated lines 653. Once the removable portion 652 has been removed, the user may then pour the contents of the food into a bowl or other receptacle.

Figure 13:
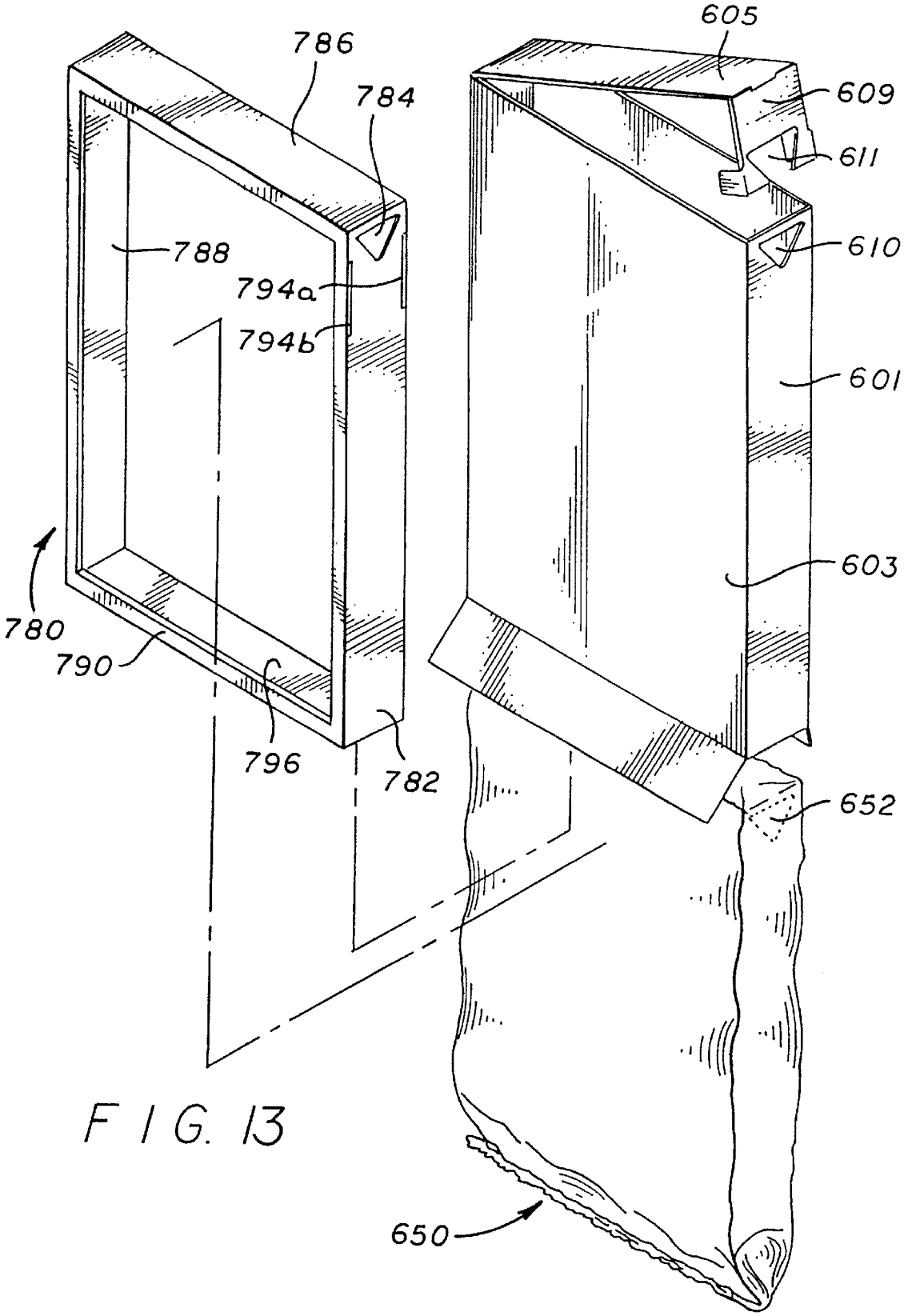
FIG. 13 is an alternative embodiment in which a four-wall cartridge is provided for insertion with the bag into the box.

FIG. 13 shows an alternative embodiment of a cartridge design. In FIG. 13, a cartridge 780 has four complete sides, rather than the three sides of FIG. 11. The cartridge 780 has a front panel 782, a top panel 786, a rear panel 788, and a bottom panel 796. A rim 790 extends about one side only of the cartridge, whereas the opposite sides of the cartridge have no rim such as 790. As in the embodiment of FIG. 11, the bag 650 is typically secured within the cartridge 780, and then the entire cartridge and bag assembly is then inserted into the box prior to securing the box shot.

Figure 14:
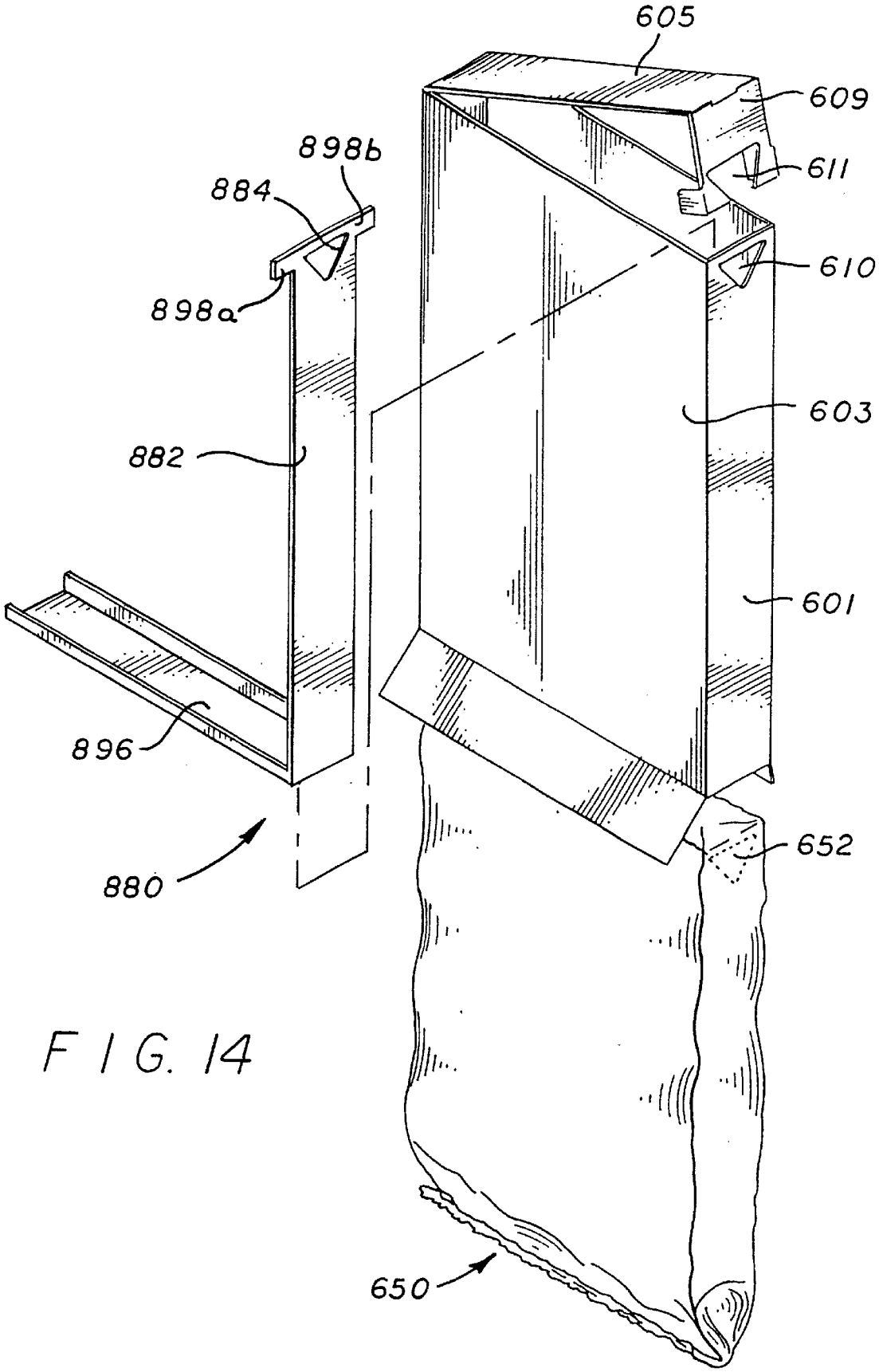
FIG. 14 is a second alternative embodiment of a cartridge to carry the bag into the box.

FIG. 14 is a further alternative embodiment of a cartridge 880. The cartridge 880 has only two sides, a front portion 882 and bottom portion 896. The front portion 882 generally has a width that is less than the front portion 601 of the box itself. Wings 898A and 898B serve to properly maintain the position of front portion 882 within the box. As with the other embodiment, the opening in the front portion of the cartridge 884 is shaped to be compatible with the opening 610 in the box itself. The bag 650 is typically adhered into place on the cartridge 880 before being inserted into the box.

Figure 15:
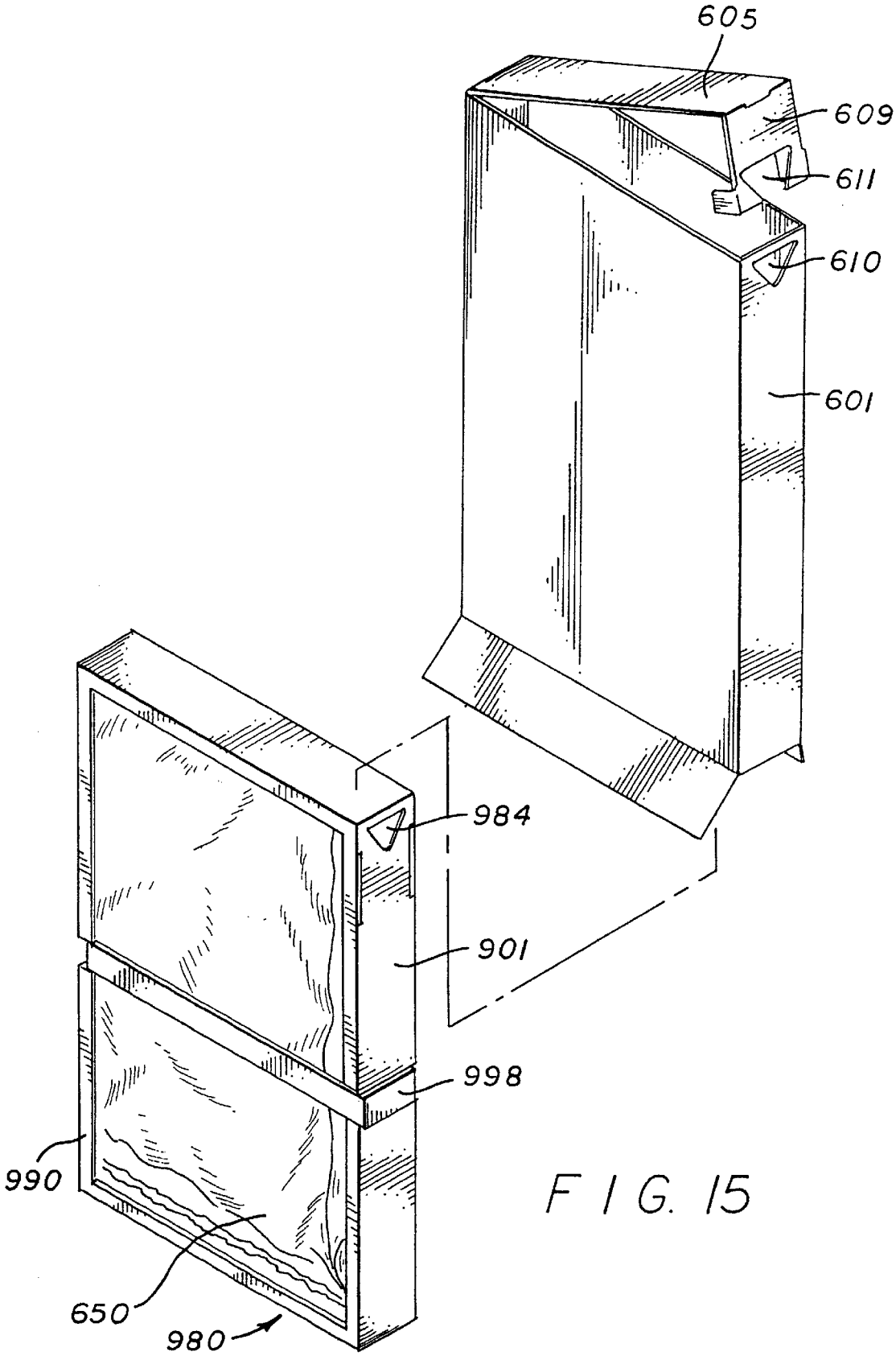
FIG. 15 is an embodiment with a cartridge, a bag and a band that extends around the cartridge to secure the bag within the cartridge.

FIG. 15 illustrates a further embodiment of the cartridge concept. A cartridge 990 retains the bag 650 and an additional band 998 extends about the outside of the cartridge 980 to secure the bag within the cartridge. The band 998 may be made out of any of the number of materials, including cardboard, plastic, rubber, woven materials and other suitable materials. As seen in FIG. 15, a portion of the rim 990 maybe omitted in the area of the band 998. Similar embodiments may have more than one band, and other embodiments may have the band extending vertically about the cartridge rather than horizontally.

Figure 16:
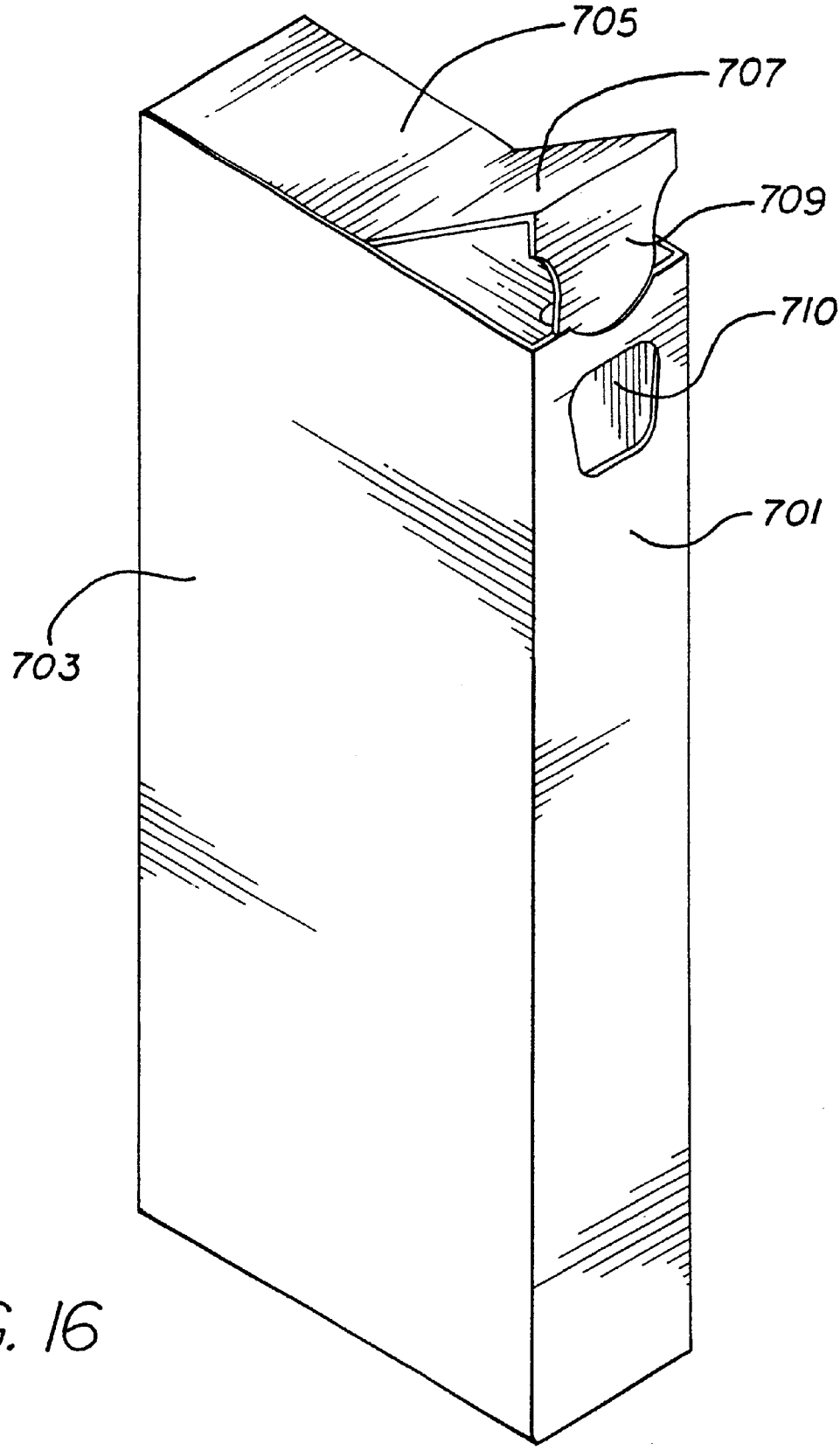
FIG. 16 is an alternative embodiment of a box having no opening in the slide.

It should be noted that the various inventive concepts discussed herein can be incorporated into any of the number of the different box designed. In addition to the box illustrated in FIGS. 11–15, for example, FIG. 16 shows yet another embodiment of a suitable box. The box of FIG. 16 includes a front panel 701, a side panel 703, a top flap 705, and a top front portion 707 that is joined with top portion 705 at a fold line. A slide 709 extends downwardly from the top front portion 707. It should be noted that the top portion 705 is typically fixed in place while top front portion 707 is allowed to rotate upwardly and downwardly from the open to the closed positions respectively. In the embodiment of FIG. 16, there is not an opening in the slide 709, and the box is opened and closed simply by moving the slide 709 from about the opening in the box 710.

Figure 17:
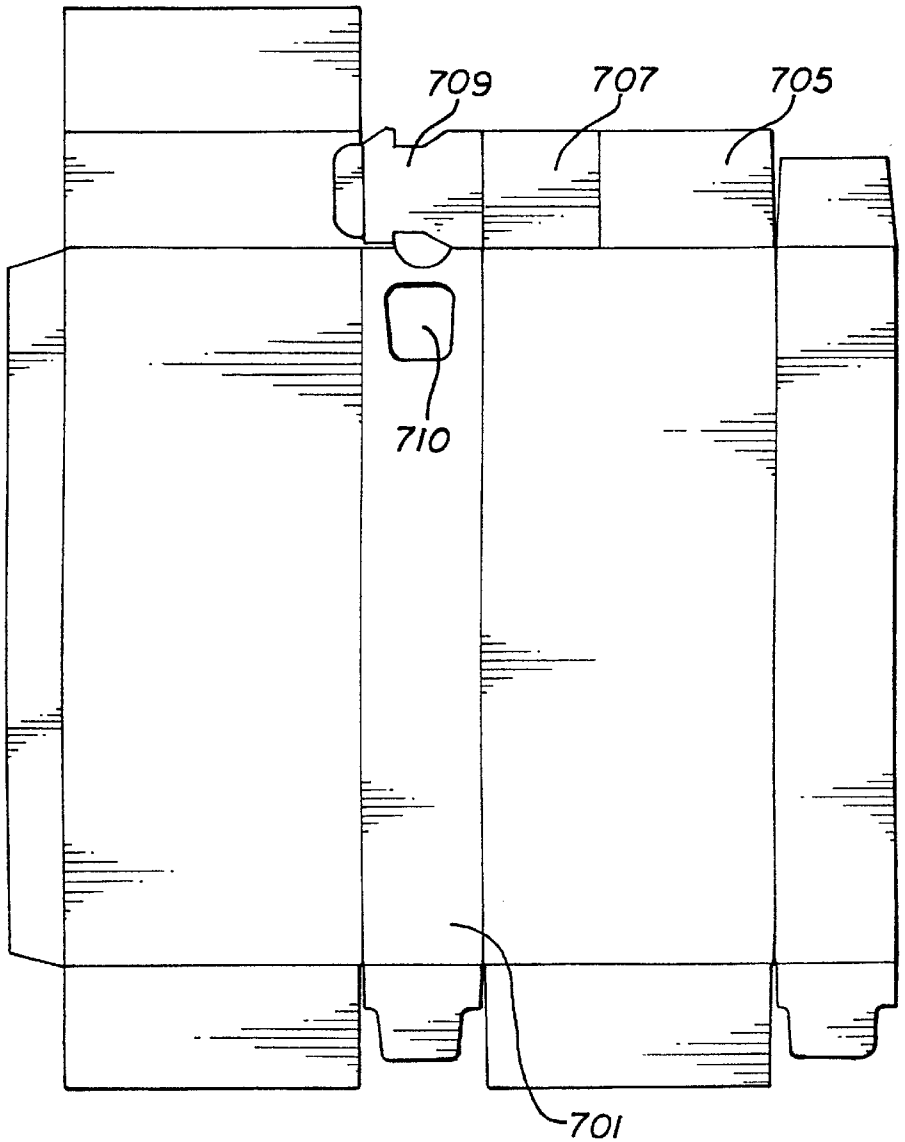
FIG. 17 is a layout of the box illustrated in FIG. 16.

As with the other embodiments, the box of FIG. 16 can be formed from a single piece of cardboard cut from a cardboard sheet FIG. 17 illustrates the cutting pattern that a die cut machine can use in order to cut a box formed from a single sheet of cardboard. The box formed can be scored where appropriate to facilitate easy folding of the form into the box of FIG. 16.

Figure 18:
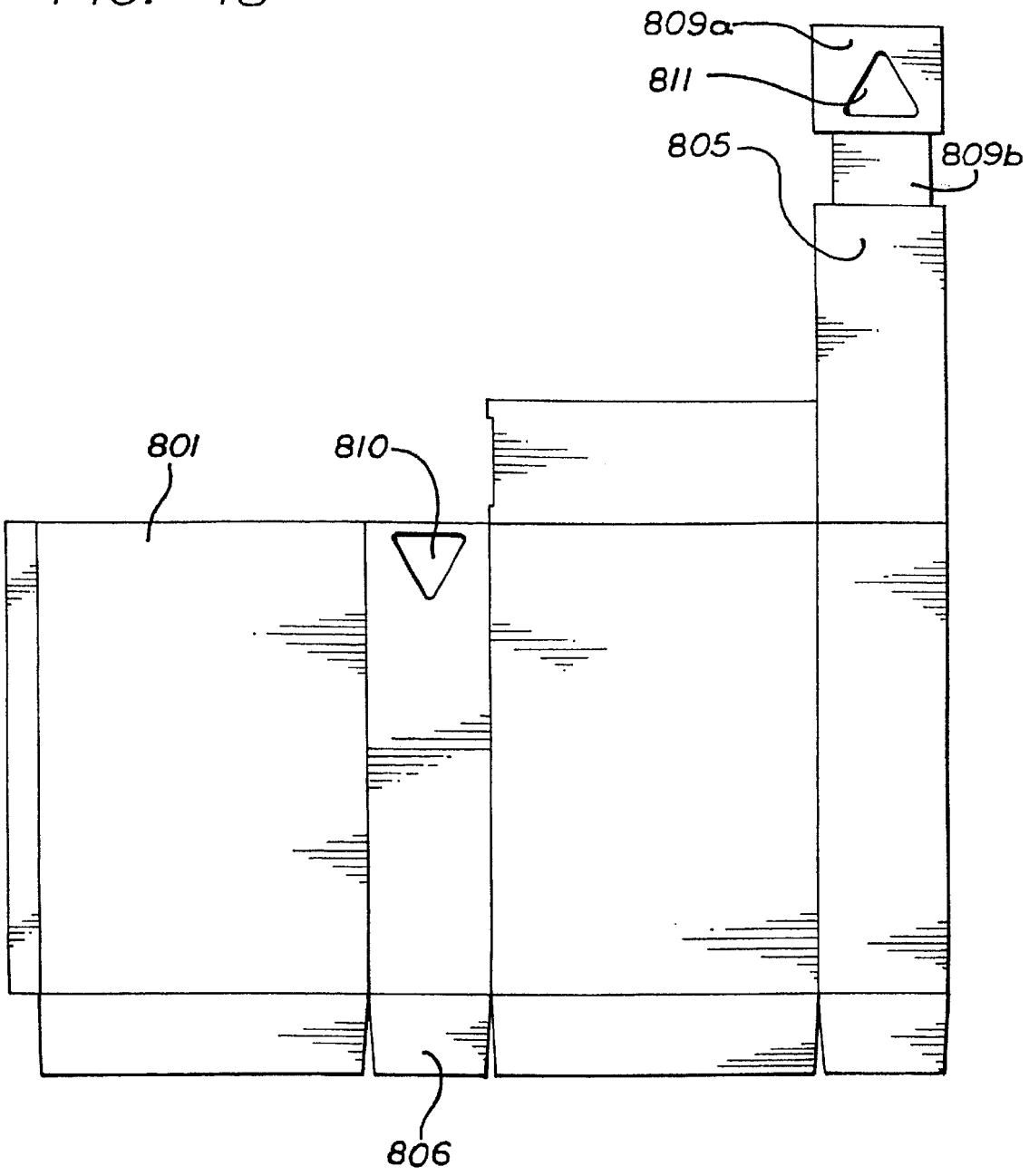
FIG. 18 is an alternative embodiment of a box having a special multi-thickness slide mechanism.

FIG. 18 illustrates a further embodiment of a box according to the present invention. As with the embodiment of FIG. 17, FIG. 18 illustrates a box that has been cut from a single sheet of cardboard. It should be noted, however, that the box of FIG. 18 can be made from several pieces of cardboard adhered together if desired. It is noted that in the embodiment of FIG. 18, the slide has two portions: a wide end portion 809A, and a narrower neck portion 809B. There is opening 811 in slide portion 809A. The portion 809A is sufficiently wide to extend across the width of a box, and to keep the slide from moving laterally within the box. Numerous other types of boxes may be used in accordance with the present invention.

Figure 20:
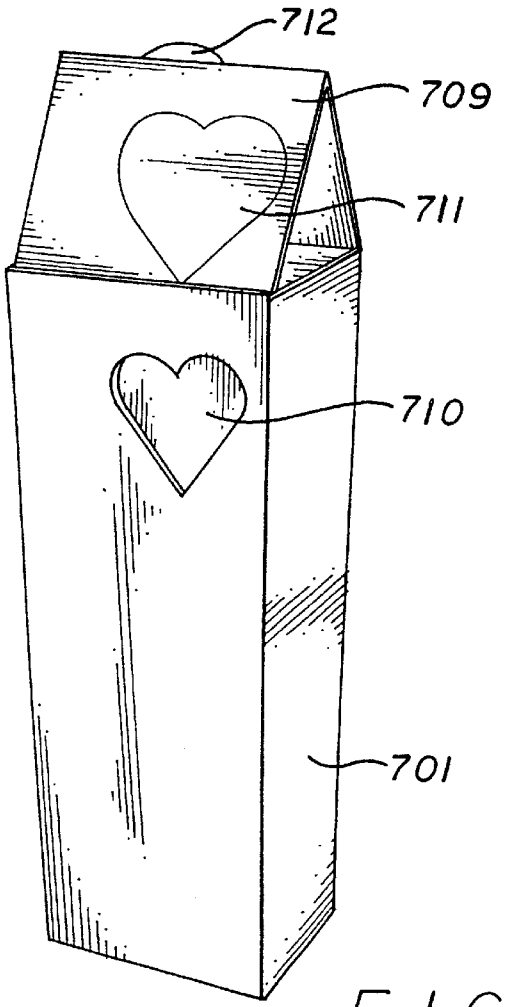
FIG. 20 is another view of the box of FIG. 19, in which a graphic of a heart is printed on the slide mechanism.
Figure 19:
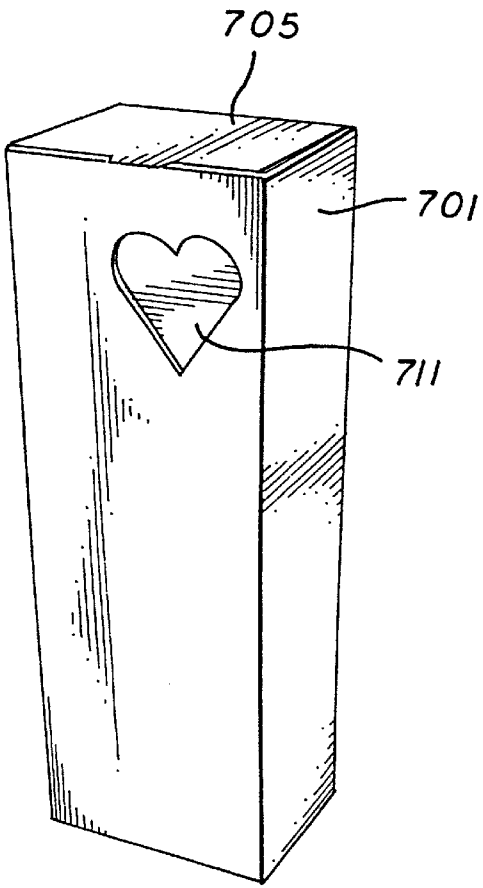
FIG. 19 is an embodiment of a package having a heart-shaped opening.

FIGS. 19–20 illustrates a further embodiment of a box according to the present invention. The box has a front opening 710 in a shape of a heart. The slide 709 has a printed graphic heart 711, which when aligned with the front opening 710, presents a printed graphic image at the box opening. However, as seen in FIG. 20, when the slide 709 is pulled upwardly into the open position, the printed graphic heart 711 moves up as well. Thus, with the use of printed graphics of the slide 709, appealing graphical effects can be accomplished with the boxes.

Figure 21:
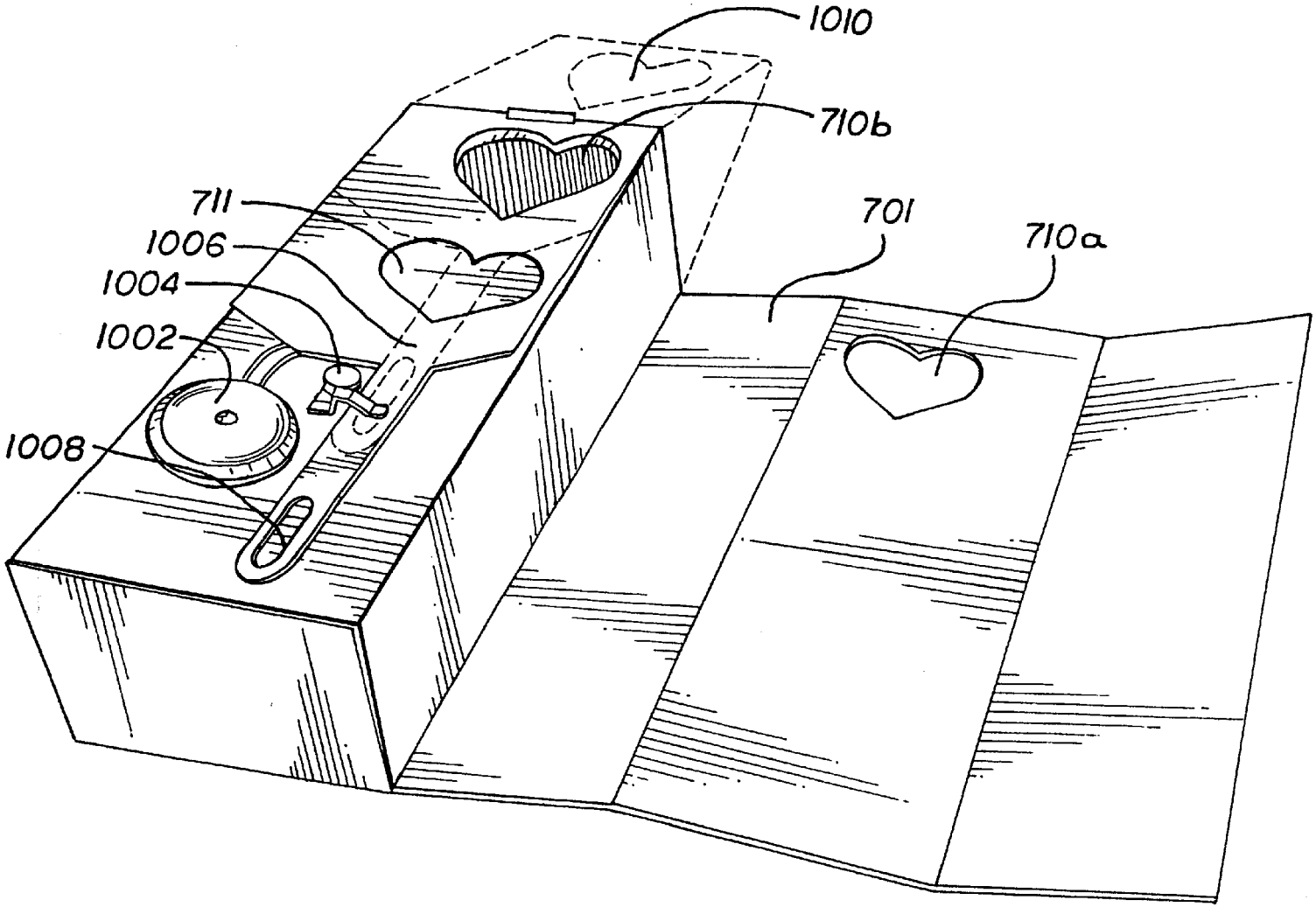
FIG. 21 is a partial layout view of the box of FIG. 20 in which the box is equipped with a sound mechanism.

A further aspect of the present invention is a mechanism to create sound when the boxes open and close. The embodiment of FIG. 21 is fitted with an audio module that is available from Clegg Industries Incorporated of Torrance, Calif., SKU No. COTP 615D. The sound module 1002 is affixed to the portion of the box, and is connected by respective wires to a metal contact plate and a switch unit 1004. When the box is put into the open position with the slide lifted up, a finger 1006 is pulled outwardly. An opening 1008 in the finger 1006 then slides upwardly until the aperture of the switch 1004 is permitted to extend through the finger 1006 at the opening 1008 to make contact with the conductive plate. The circuit is then closed and the sound unit emits sound. The sound may be any of a variety of different sounds, including music, voice or any other sound that can be programmed on a sound chip. The sound chip concept to FIG. 21 can be extended to any other embodiments of the present invention, including the embodiments that used cartridges to hold and insert the bag into the box.

Figure 22:
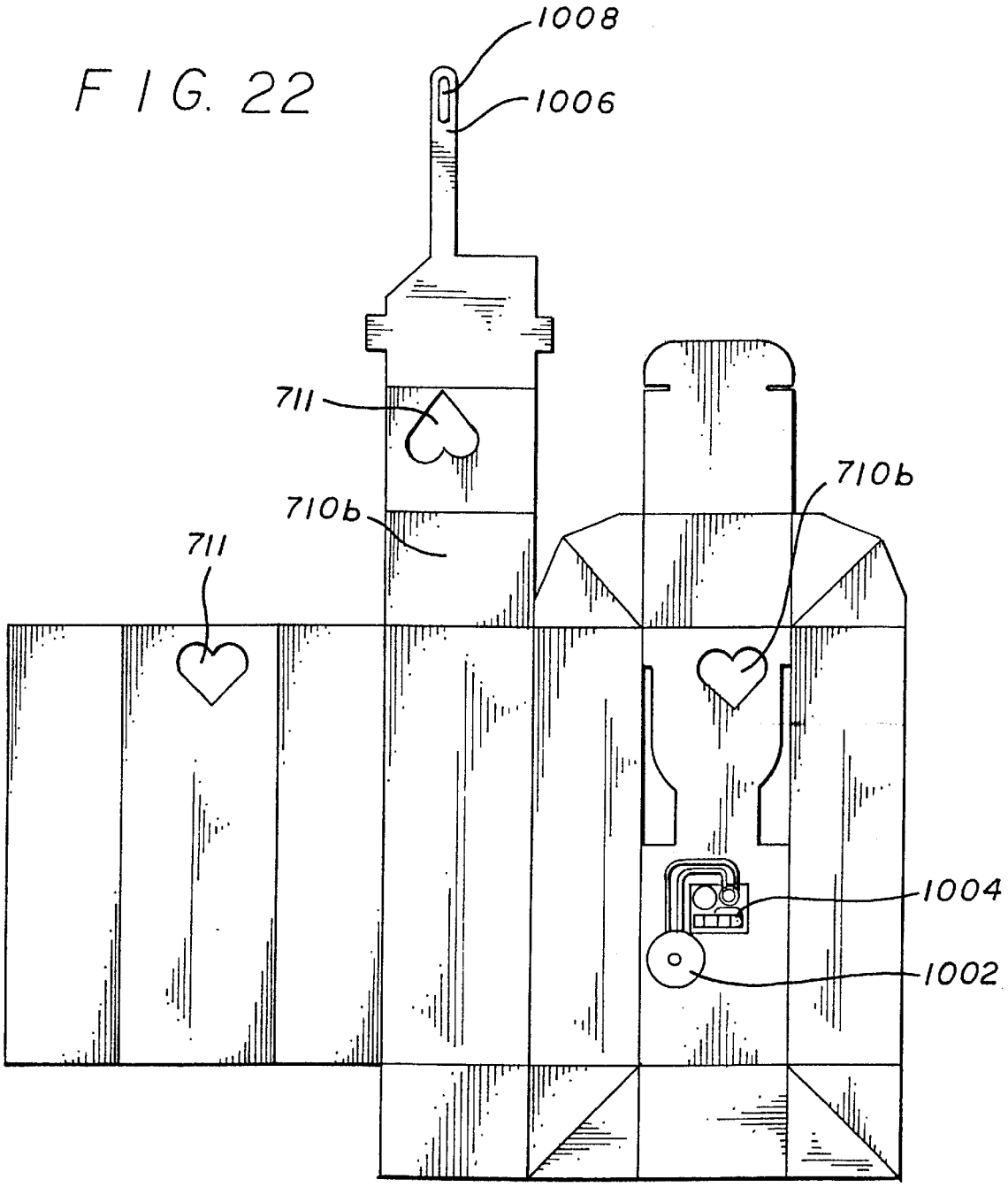
FIG. 22 is a full layout view of the box of FIG. 21.

FIG. 22 illustrates a cut out from which the box of FIG. 21 can be constructed. The sound module 1002 and the switch unit 1004 have been installed onto the cut out, typically by means of an adhesive.

Figure 23:
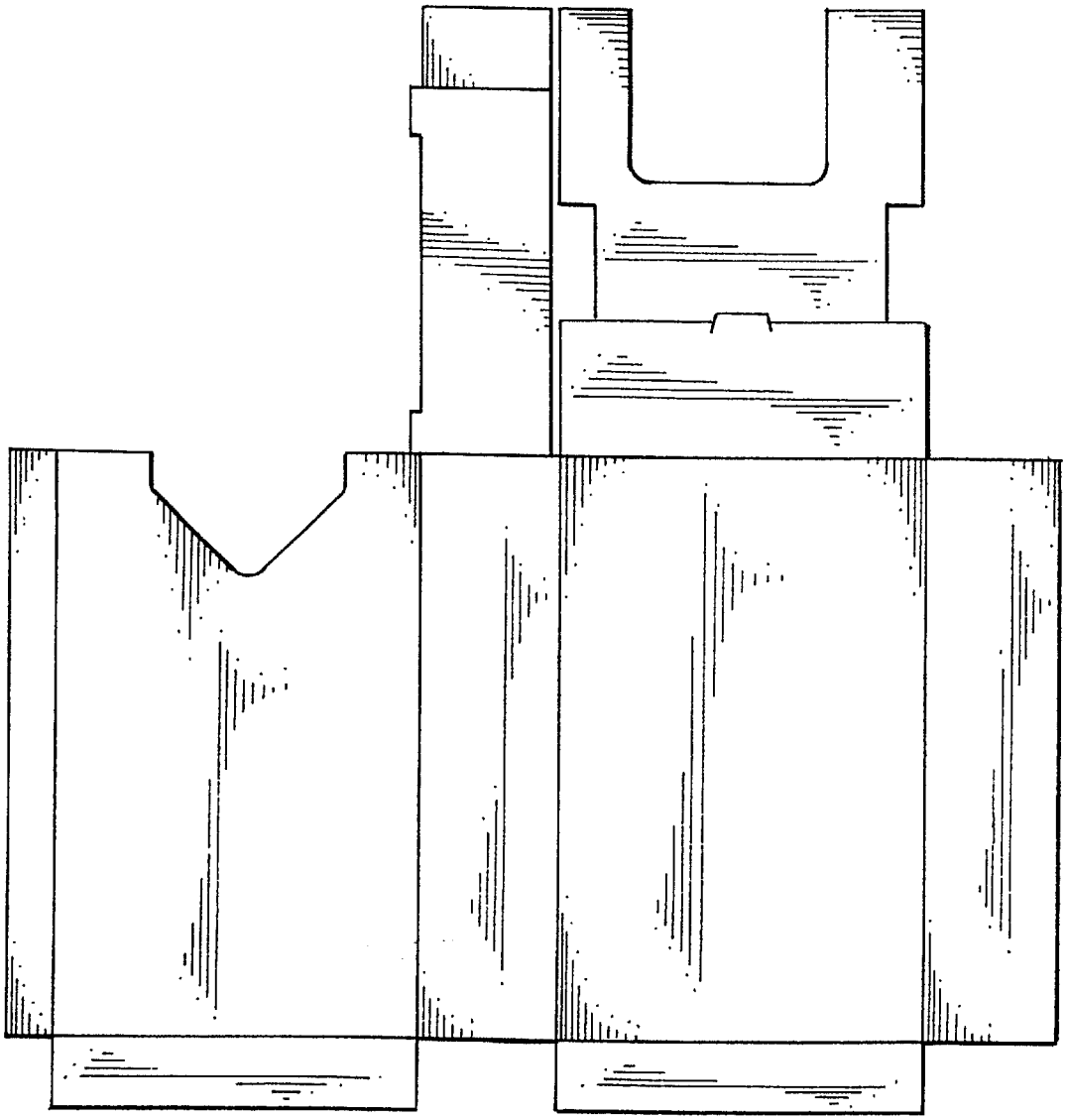
FIG. 23 is a layout view of an alternative box design.
Figure 24:
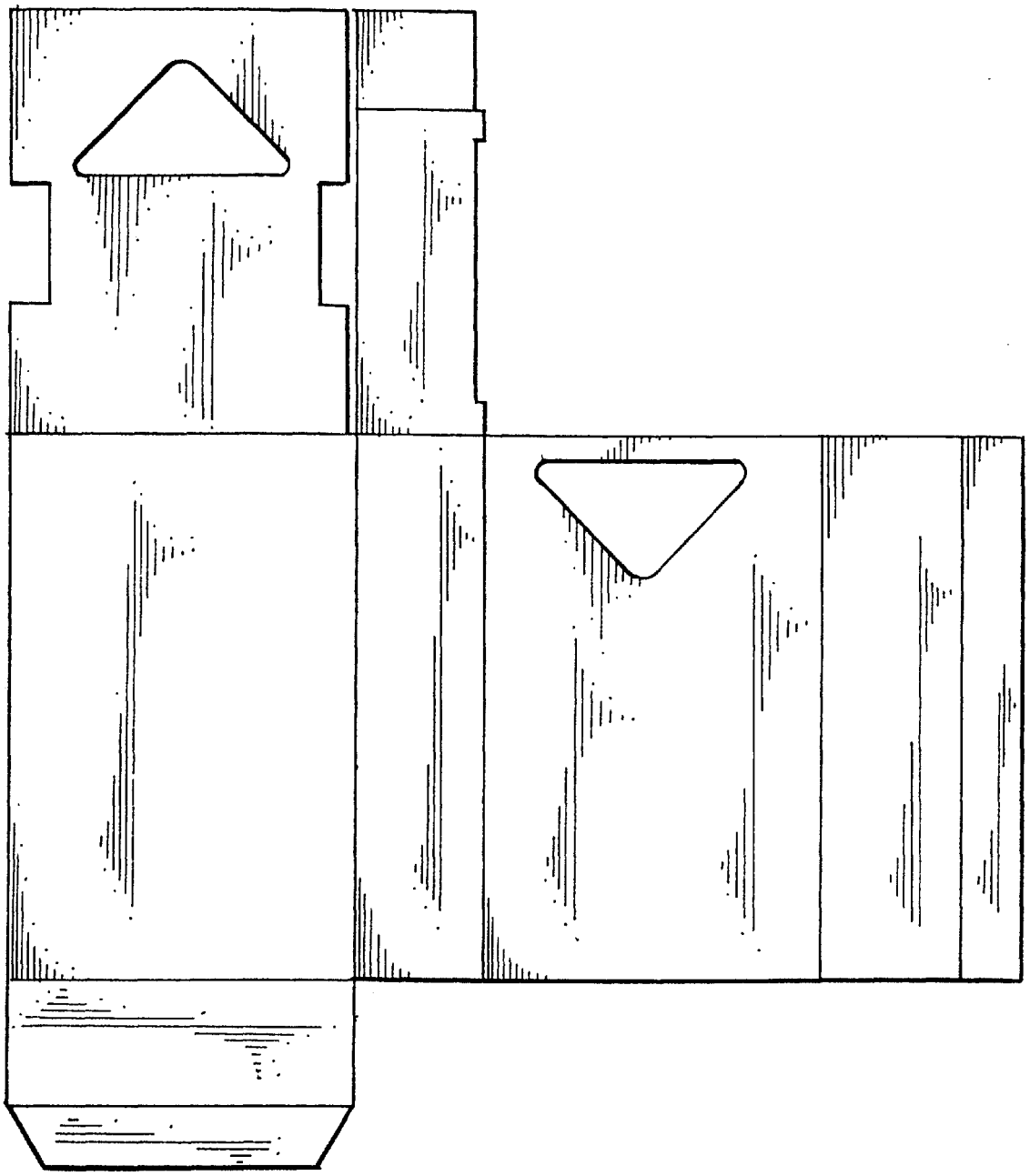
FIG. 24 is a layout view of an additional box design.

Turning now to further alternative embodiments of the present invention, FIG. 23 and 24 are cut outs that can be folded into various embodiments of boxes according to the present invention. As can be seen, there is considerable room for variation in the precise configuration of the box. Either of the designs of the FIG. 23 and FIG. 24 can be used in accordance with the various features of the present invention.

The embodiments of the present invention may be formed from a wide variety of materials. The presently-preferred material is sulfate cellulose cardboard. However, the box may alternatively be made of plastic or wax. Other materials such as paper and wood may also be utilized to form part or all of the box in special embodiments.

In a further embodiment, the box opening and/or the slide opening may be sealed with a small sheet of plastic, wax paper, or other sealing material. The small sheet may be adhered about the edges of the opening with an adhesive, or otherwise attached to the box. The small sheet may be perforated or provided with lines of weakness to define a removable portion, which the user removes before dispensing the contents of the box. A tab or tear strip may be provided on the sealing sheet to assist in removing the removable portion. Alternatively, the sheet may be a sticker that the user peels away rather than tearing. This embodiment may be used without an inner liner with some pourable products, such as powdered dishwasher soap and rice, to name just a few.

In a further alternative embodiment, a bag is provided with a zipper or other known at sliding closure system. In this embodiment, the user slides the closure to an open position rather than tearing along a line of weakness. The bag can then be re-sealed by sliding the closure to a shut position.

It should be noted that the relative dimensions of the drawings are approximate. The drawings are intended to convey general concepts and are not precise engineering drawings. The particular dimensions of the various embodiments may be adjusted as necessary. For example, but not limitation, the openings 210 and 315 in FIGS. 4 and 5, respectively, may be made proportionately larger or smaller in particular embodiments of the box, as can the various other openings in the boxes and bags.

Accordingly, the present invention is not limited precisely to the arrangements as shown in the drawings and as described in detail hereinabove.

What is claimed is:

1. A system for conveniently storing and dispensing pourable items comprising:

a front wall having an opening and an inside surface;

a back wall;

a first and a second side wall;

a top and a bottom flap;

a slide that is in contact with the inside surface of the front wall, said slide having an opening;

wherein said front wall, said back wall, said first and second side walls, and said top and bottom flaps are interconnected so as to form a box, said slide being movable between an open position in which said slide opening substantially aligns with said front wall opening and a closed position in which said slide opening is entirely out of alignment with said front wall opening, thereby closing said box;

an inner liner inside said box comprising a removable area defined by one or more lines of weakness, said removable area being positioned adjacent to at least a portion of said front wall opening; and a retaining cartridge for said inner liner.

2. A system as defined in claim 1, wherein said one or more lines of weakness comprise perforations.

3. A system as defined in claim 1, wherein said retaining cartridge has four sides.

4. A system as defined in claim 1, wherein said retaining cartridge has three sides.

5. A system as defined in claim 1, wherein said retaining cartridge has two sides.

6. A system as defined in claim 1, wherein said retaining cartridge includes a liner retention band.

7. A system as defined in claim 1, wherein said system comprises a sound module.

8. A system as defined in claim 7, said sound module being activated to emit sound in said open position only.

9. A system as defined in claim 1, wherein said slide comprises printed graphics positioned on said slide so as to appear in said front wall opening in said closed position.

10. A method of dispensing a pourable item comprising:

forming a packaging system as defined in claim 1;

putting said slide into said open position;

removing said removable section from said inner liner; and pouring at least a portion of the contents of said inner liner through said opening in said box.

11. A system for conveniently storing and dispensing pourable items comprising:

a front wall having an opening and an inside surface;

a back wall;

a first and a second side wall;

a top and a bottom flap;

a slide that is in contact with the inside surface of the front;

wherein said front wall, said back wall, said first and second side walls, and said top and bottom flaps are interconnected so as to form a box, said slide being movable between a closed position in which said slide substantially blocks said front wall opening and an open position in which said slide is clear of said front wall opening, thereby opening said box;

a bag inside said box comprising a removable area defined by one or more lines of weakness, said removable area being positioned adjacent to said front wall opening, said removable area comprising a tab for removing said removable area from said bag; and a retaining cartridge for said inner liner.

12. A system as defined in claim 11 further comprising a sound module that is activated when said slide is in the open position.

13. A packaging system for storing and dispensing pourable items comprising:

a box having an opening;

an inner liner in said box; and a retaining cartridge for said inner liner;

said inner liner comprising a removable portion that is positioned adjacent to said opening in said box, said packaging system having a first mode for longer term storage in which said removable portion remains intact to seal said inner liner, and a second mode for despensing the contents of said inner liner through said opening in which said removable portion has been at least partially removed from said inner liner;

wherein said removable portion comprises a member from the group constituting a sticker, a perforated area, and an area that a user cuts out with a cutting instrument.

14. A packaging system for storing and dispensing pourable items comprising:

a box having an opening;

an inner liner in said box; and a retaining cartridge for said inner liner;

said inner liner comprising a removable portion that is positioned adjacent to said opening in said box, said packaging system having a first mode for longer term storage in which said removable portion remains intact to seal said inner liner, and a second mode for dispensing the contents of said inner liner through said opening in which said removable portion has been at least partially removed from said inner liner;

wherein the removable portion is a sticker, wherein said inner liner comprises at least one area having a release coating to facilitate removal of said sticker.

15. A system for conveniently storing and dispensing pourable items comprising:

blank means for forming a box an inner liner to be placed inside the box once said box is formed; and means for retaining said inner liner within said box after said box has been formed;

wherein said system further includes a sound unit.

* * * * *